US010646032B2

(12) United States Patent
Angelini et al.

(10) Patent No.: US 10,646,032 B2
(45) Date of Patent: May 12, 2020

(54) DESK MOUNTABLE WORKSTATION

(71) Applicant: Movi Workspace Pty Ltd, Hawthorn (AU)

(72) Inventors: Daniel Paul Angelini, Camberwell (AU); Robert Sim, Melbourne (AU)

(73) Assignee: Movi Workspace Pty Ltd, Hawthorn (AU)

( * ) Notice: Subject to any disclaimer, the term of this patent is extended or adjusted under 35 U.S.C. 154(b) by 137 days.

(21) Appl. No.: 15/571,766

(22) PCT Filed: Aug. 15, 2017

(86) PCT No.: PCT/AU2017/050867
§ 371 (c)(1),
(2) Date: Nov. 3, 2017

(87) PCT Pub. No.: WO2018/045414
PCT Pub. Date: Mar. 15, 2018

(65) Prior Publication Data

US 2019/0125073 A1 May 2, 2019

(30) Foreign Application Priority Data

Sep. 8, 2016 (AU) ..... 2016903609
Mar. 7, 2017 (AU) ..... 2017900776

(51) Int. Cl.
*A47B 21/02* (2006.01)
*A47B 9/16* (2006.01)
(Continued)

(52) U.S. Cl.
CPC ..... *A47B 21/02* (2013.01); *A47B 9/16* (2013.01); *A47B 21/04* (2013.01); *B66F 7/06* (2013.01);
(Continued)

(58) Field of Classification Search
CPC ..... A47B 21/02; A47B 21/04; A47B 9/16; A47B 9/00; A47B 9/20; A47B 2200/004;
(Continued)

(56) References Cited

U.S. PATENT DOCUMENTS 1,794,165 A * 2/1931 Gannaway ..... B66F 7/0608 254/126
2,559,887 A * 7/1951 Alfred ..... D06F 81/02 108/99
(Continued)

FOREIGN PATENT DOCUMENTS

FR 2624176 * 6/1989

OTHER PUBLICATIONS

International Searching Authority, Written Opinion, issued in connection with International Application No. PCT/AU2017/050867, dated Oct. 26, 2017, 10 pages.
(Continued)

*Primary Examiner* — Janet M Wilkens
(74) *Attorney, Agent, or Firm* — Hanley, Flight & Zimmerman, LLC

(57) ABSTRACT

An adjustable desk mountable workstation (90) comprising: a platform (12) adapted to support a computer keyboard thereon; and a pair of symmetrically opposed legs (91) for standing or mounting on a desk and on which the platform (12) is mounted, the legs (91) being adjustable so as to alter the height of the platform (12) above the desk, each leg (91) having outer and inner ends, wherein adjustment of the legs (91) involves concomitant pivoting without displacement at their respective outer ends and pivoting plus horizontal displacement at their respective inner ends, thereby altering the height of the platform (91) with respect to the desk.

31 Claims, 38 Drawing Sheets

(51) Int. Cl.
*B66F 7/06* (2006.01)
*A47B 21/04* (2006.01)

(52) U.S. Cl.
CPC ..... *B66F 7/0691* (2013.01); *A47B 2200/004* (2013.01); *A47B 2200/0066* (2013.01)

(58) Field of Classification Search
CPC ..... A47B 2200/0066; A47B 2200/056; A47B 2200/0062; A47B 2200/0057; A47B 2200/0059; A47B 13/081; A47B 13/088; A47B 13/003
USPC ..... 108/20, 147, 50.01, 50.02, 144.11; 312/306, 312, 223.3, 196; 248/157, 277, 248/575, 588, 631, 164, 432, 439, 188.2, 248/550, 421, 5, 62, 585, 431, 280.11, 248/292.11, 919, 920, 923, 42, 1, 562
See application file for complete search history.

(56) References Cited

U.S. PATENT DOCUMENTS 2,675,285 A * 4/1954 Terry ..... A61G 13/009 5/618
2,814,541 A * 11/1957 Derman ..... A47B 3/0911 108/145
3,350,065 A 10/1967 Mankey
4,575,975 A 3/1986 Eisenberg
4,718,355 A * 1/1988 Houghton ..... A47B 9/16 108/147
4,754,713 A * 7/1988 Chatenay epouse Compagnone ..... A63J 1/00 100/144
5,323,695 A 6/1994 Borgman et al.
5,325,794 A * 7/1994 Hontani ..... A47B 3/0911 108/115
5,432,966 A * 7/1995 Berta ..... A61G 1/0562 296/20
6,920,656 B2 * 7/2005 Roussy ..... A61G 7/012 16/19
9,049,923 B1 6/2015 Delagey et al.
9,107,781 B1 * 8/2015 Edgerton ..... A61G 7/012
10,209,705 B1 * 2/2019 Labrosse ..... A47B 21/02
2005/0167548 A1 8/2005 Benden et al.
2008/0203865 A1 8/2008 Chouinard et al.
2013/0014674 A1 * 1/2013 Burkhalter ..... A47B 9/16 108/50.11
2015/0272316 A1 * 10/2015 Flaherty ..... A47B 9/16 108/116

OTHER PUBLICATIONS

International Searching Authority, International Search Report, issued in connection with International Application No. PCT/AU2017/050867, dated Oct. 26, 2017, 7 pages.

* cited by examiner

DESK MOUNTABLE WORKSTATION

CROSS REFERENCE TO RELATED APPLICATIONS

This patent arises from an application claiming priority to PCT/AU2017/050867, filed Aug. 15, 2017, which claims priority to AU2016903609, filed Sep. 8, 2016, and AU 2017900776, filed Mar. 7, 2017. PCT/AU2017/050867, AU2016903609, and AU 2017900776 are incorporated herein by reference in their entireties.

TECHNICAL FIELD

The present invention relates to desk mountable workstations. In a particular aspect, the invention relates to height adjustable workstations mountable on fixed height desks.

BACKGROUND ART

Any discussion of documents, devices, acts or knowledge in this specification is included to explain the context of the invention. It should not be taken as an admission that any of the material forms a part of the prior art base or the common general knowledge in the relevant art in Australia or elsewhere on or before the priority date of the disclosure and broad consistory statements herein.

Consistent prolonged sitting at a work desk is associated with serious health conditions, including disk related low back pain, heart disease, diabetes, cancer and reduced life span. Given this, it may be advantageous to provide an apparatus, such as that of the present invention, which enables a user to alternate between sitting and standing at their work desk, thereby enabling the user to reduce the length of each sitting period, as well as overall sitting time.

One solution to this problem has been to make the work desk itself height adjustable. However, such solutions are typically more complex, expensive and prone to breakage, and more difficult to store and transport, than fixed height desks. Therefore, height adjustable work desks have not been taken up as a suitable solution for the most part, particularly not as a means of prophylaxis.

U.S. Patent Publication no. 2015/0250303 A1 describes an alternative solution in which a height adjustable platform is sat upon a fixed height desk. Specifically, the adjustable desk platform described includes: a monitor platform defining a substantially planar work surface; a base located beneath the monitor platform, the base defining a bottom surface without legs that is adapted to sit on an existing desk; first and second sets of arms coupling the monitor platform to the base, wherein the first and second sets of arms are adapted for movement of the monitor platform substantially in parallel with the base between a fully raised position and a fully lowered position; and a user-operable locking mechanism associated with the upper platform, the locking mechanism adapted to releasably lock the upper platform in the fully raised position, and in at least one intermediate position between the fully raised position and the fully lowered position. A computer monitor is to be mounted on the monitor platform, and the apparatus further includes a keyboard tray for mounting of a keyboard thereon.

Unfortunately, the solution described in U.S. Patent Publication no. 2015/0250303 A1 suffers from various drawbacks. For instance, in order to raise the monitor platform, the sets of arms pivot at their lower ends without any simultaneous horizontal movement of the their upper ends with respect to the monitor platform, thereby resulting in forward movement of the monitor platform into the limited work space of a user as the platform is raised. Further, such an off balanced arrangement requires the use of a counterweight, adding unnecessary weight to the device. Moreover, the height of the monitor platform is not continuously lockable in the sense that an anchor must be selectively engaged in one of a number of perforations to lock the platform at a predetermined height. Of course, the ergonomic height of the platform for a user may not always correspond with the predetermined heights available. Additionally, to raise or lower the monitor platform, the user must use a handle to release an anchor and then manually lift or lower the upper platform. This places undue stress on the user's body given the substantial weight of various components such as the platform and monitor resting thereupon. Although a booster spring is used to assist upward movement, the assistance it provides is limited and it is only effective in providing assistance in or near the fully lowered position. Further still, whilst mentioning in passing that the keyboard tray can be located at an adjustable distance from the base platform, the trays in the embodiments shown and described are not height adjustable. Thus, the absence of embodiments with an enabling disclosure of a keyboard tray which is height adjustable independently of the monitor platform presents difficulties for ergonomically setting up various users with differing vertical distances between the eye line and the elbow line.

Thus, it may be advantageous to provide a new height adjustable workstation which is mountable on a fixed height desk, and which reduces, limits, overcomes, or ameliorates some of the problems, drawbacks, or disadvantages associated with prior art devices, or provides an effective or improved alternative to such devices.

DISCLOSURE OF THE INVENTION

In one aspect, the invention provides an adjustable desk mountable workstation comprising:

- a platform adapted to support a computer keyboard thereon; and
- a support structure for standing or mounting on a desk and on which the platform is disposed, the support structure being adjustable so as to alter the height of the platform above the desk.

In another aspect, the invention provides an adjustable desk mountable workstation comprising,

- a first platform, and
- a first adjustable leg on which the first platform is disposed, the first leg having first and second ends, wherein adjustment of the leg comprises concomitant: pivoting of the leg at its first end, pivoting of the leg at its second end, and running, rolling, translation, or sliding of the leg at its second end, thereby resulting in a change in height of the first platform.

The running, rolling, translation, or sliding of the first leg at its second end may be in a substantially horizontal direction.

The change in height of the first platform may be absent any horizontal translation thereof.

There may be a pair of first legs. Each first leg may extend in opposite directions. The pair of first legs may be opposed. They may be symmetrically opposed. They may be symmetrical in a transverse plane. The tranverse plane may be a midline transverse plane.

There may be a pair of swing member. The swing members may be opposed. They may be symmetrically opposed. They may be symmetrical in a transverse plane. The tranverse plane may be a midline transverse plane.

There may be a pair of running members. The running members may be opposed. They may be symmetrically opposed. They may be symmetrical in a transverse plane. The tranverse plane may be a midline transverse plane. The workstation may further comprise, a second platform, and a second adjustable leg disposed on the first platform, and on which the second platform is disposed, the second leg having first and second ends, wherein adjustment of the second leg comprises concomitant: pivoting of the second leg at its first end, pivoting of the second leg at its second end, and running, rolling, translation, or sliding of the second leg at its second end, thereby resulting in a change in height of the second platform.

The running, rolling, translation, or sliding of the second leg at its second end may be in a substantially horizontal direction.

The change in height of the second platform may be absent horizontal translation thereof.

There may be a pair of second legs. Each second leg may extend in opposite directions.

In another aspect, the invention provides an adjustable desk mountable work station comprising:

a first support structure for standing or mounting on the desk;

a first platform supported on the first support structure; and an adjustment mechanism for adjusting the height of the first platform above the desk, the adjustment mechanism comprising, a running portion adapted to run along a frame of the first platform, an inner portion of the lower support structure being pivotally connected with the running portion, and a swing member for causing pivoting of the lower support structure about its pivotal connection with the running portion.

In another aspect, the invention provides an adjustable desk mountable workstation comprising:

a lower support structure for standing or mounting on the desk, a lower platform supported by the lower support structure, the lower platform being adapted to support a computer keyboard thereon, a lower adjustment mechanism for adjusting the height of the lower platform above the desk, an upper support structure mounted on the lower platform, an upper platform supported by the upper support structure, the upper platform being adapted to support a computer screen thereon, and an upper adjustment mechanism for adjusting the height of the upper platform above the lower platform.

In yet another aspect, the invention provides an adjustable desk mountable work station comprising:

a first or lower support structure for standing or mounting on the desk, the lower support structure comprising, a stationary base for standing or mounting on the desk, a leg having inner and outer ends, the outer end of the leg being pivotally connected to the base, and a strut having inner and outer ends, the inner end of the strut being pivotally connected to the leg, a lower platform supported on the lower support structure, the lower platform being adapted to support a computer keyboard thereon, the outer end of the strut member being pivotally connected with the lower platform, the lower platform having a frame, and an adjustment mechanism for adjusting the height of the lower platform above the desk, between a lowered configuration in which the leg is folded towards or along the platform, and a raised configuration in which the leg is extended away from the platform, the adjustment mechanism comprising, a running member adapted to run along the frame, the inner end of the leg being pivotally connected with the running member, and a swing member for causing pivoting of the leg about its connection with the running member, wherein elevation of the lower platform from the lowered position is initiated by the swing member urging the leg to pivot downwardly about its pivotal connection with the running member, following which outward movement of the running member along the frame causes the inner end of the leg to travel outward and pivot further downward, resulting in extension of the leg and thereby raising the lower platform.

The swing member may comprise a ramped portion along which a portion of the leg may travel. The swing member may comprise a block.

There may be a pair of legs. The legs may extend away from each other from their inner to outer ends. Each leg may extend laterally outward.

The adjustment mechanism may comprise a further running member. The further running member may be configured to move outward. The running member may initially remain stationary during raising of the lower platform whilst the further running member moves outward. Then, once the swing member has finished urging the leg to pivot downwardly, the running member may move outwardly with the further running member until leg extension is complete.

The adjustment mechanism may be continuously adjustable. It may be manually adjustable by use of a handle. The adjustment mechanism may further comprise a screw mechanism which is connected with and rotatable by manual rotation of the handle. Activation of the screw mechanism may result in outward movement of the inner running member.

The work station may further comprise:

a second or upper support structure for standing or mounting on the lower platform, the upper support structure comprising, a stationary upper base for standing or mounting on the lower platform, an upper leg having inner and outer ends, the outer end of the upper leg being pivotally connected to the upper base, and an upper strut having inner and outer ends, the inner end of the upper strut being pivotally connected to the upper leg, an upper platform supported on the upper support structure, the upper platform being adapted to support a computer monitor thereon, the outer end of the upper strut member being pivotally connected with the upper platform, the upper platform having an upper frame, and an upper adjustment mechanism for adjusting the height of the upper platform above the lower platform, between a lowered configuration in which the upper leg is folded towards or along the upper platform, and a raised configuration in which the upper leg is extended away from the upper platform, the upper adjustment mechanism comprising, an upper running member adapted to run along the frame, the inner end of the upper leg being pivotally connected with the upper running member, and an upper swing member for causing pivoting of the upper leg about its connection with the upper running member, wherein elevation of the upper platform from its lowered position is initiated by the upper swing member urging the upper leg to pivot downwardly about its pivotal connection with the upper running member, following which outward movement of the upper running member along the upper frame causes the inner end of the upper leg to travel outward and pivot further downward, resulting in extension of the upper leg and thereby raising the upper platform.

The upper swing member may comprise a ramped portion along which a portion of the upper leg may travel. The upper swing member may comprise an upper block.

There may be a pair of upper legs. The upper legs may extend away from each other from their inner to outer ends. Each upper leg may extend laterally outwardly.

The upper adjustment mechanism may comprise a further upper running member. The further upper running member may be configured move outwardly. The upper running member may initially remain stationary during raising of the lower platform whilst the further upper running member moves outward. Then, once the swing member has finished urging the leg to pivot downwardly, the running member may move outwardly with the further running member until leg extension is complete. The upper adjustment mechanism may be continuously adjustable. It may be manually adjustable by use of a handle. The upper adjustment mechanism may further comprise a screw mechanism which is connected with and rotatable by manual rotation of the handle. Activation of the upper screw mechanism may result in outward movement of the inner running member.

In another aspect, the invention provides an adjustable desk mountable workstation comprising:

a platform;

an adjustable support on which the platform is disposed; and an automatic adjustment mechanism for automatically adjusting the height of the platform above the desk. The height of the platform may be automatically adjustable to a pre-determined, pre-saved or pre-set height.

The workstation may comprise a timer. The timer may be adapted to signal a user when the timer runs out. The timer may run whilst the platform height remains stationary. The timer may reset on height adjustment of the platform.

The automatic adjustment mechanism may comprise a computer. The computer may comprise the timer.

The computer may comprise a processor. The computer may further comprise or be linked with a memory, user interface, display, power supply and/or network interface. The memory may store coded instructions. The processor may be adapted to execute the coded instructions.

The automatic adjustment mechanism may comprise a motor. When in operation, the motor may create a rotational torque for adjusting the adjustable support, thereby raising or lowering the platform. The computer or processor may operate the motor.

The user interface may comprise user input means. The user input means may comprise one or more touch or push buttons.

The display may be adapted to display numerals representing the height of the platform. The computer or processor may operate the display.

In another aspect, the invention may provide a method of operating a desk mountable workstation having an automatic height adjustable platform, the method comprising:

receiving input from a user relating to a height of the platform;

saving the inputted height into a memory of or linked with the workstation;

receiving input from a user to adjust the platform height to the saved height;

retrieving the saved height from the memory of or linked with the workstation; and automatically adjusting the height of the platform to the saved height.

In another aspect, the invention may provide a method of operation of a desk mountable workstation having an automatic height adjustable platform, the method comprising:

receiving input from a user, via a user interface of the workstation, relating to a height of the platform;

saving the inputted height into a memory of the workstation;

receiving input from a user to adjust the platform height to the saved height;

retrieving the saved height from the memory of the workstation; and automatically adjusting the height of the platform to the saved height.

The method may comprise receiving input from the user relating to the duration of a timer of the workstation, running the timer whilst the platform is stationary, and triggering a signal to the user, or automatically adjusting the height of the platform, on completion of the timer.

BRIEF DESCRIPTION OF THE DRAWINGS

In order that the invention may be more clearly understood and put into practical effect there shall now be described in detail preferred constructions of the invention. The ensuing description is given by way of non-limitative examples only and is with reference to the accompanying drawing, wherein.

MODES FOR CARRYING OUT THE INVENTION

Figure 1:
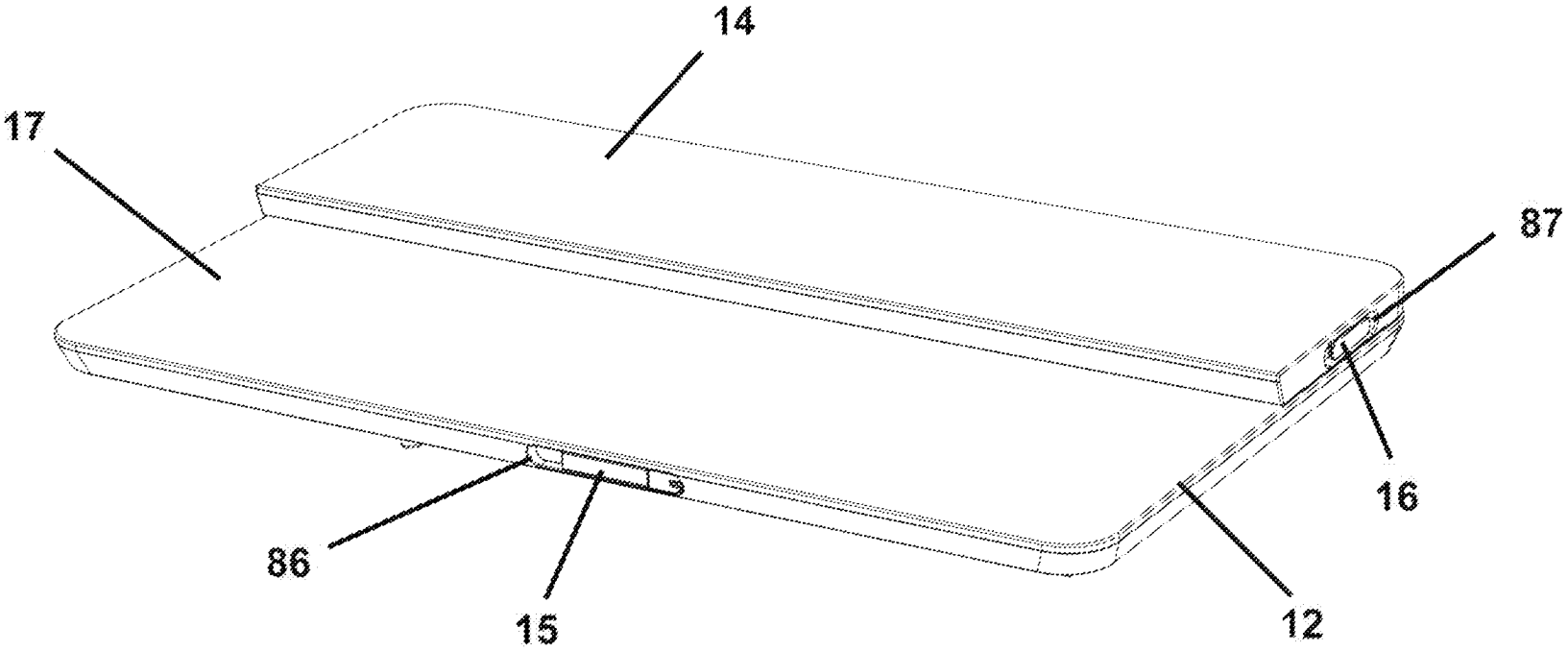
FIG. 1 is top perspective view of a first version of a desk mountable workstation in accordance with the invention, in a folded configuration.
Figure 2:
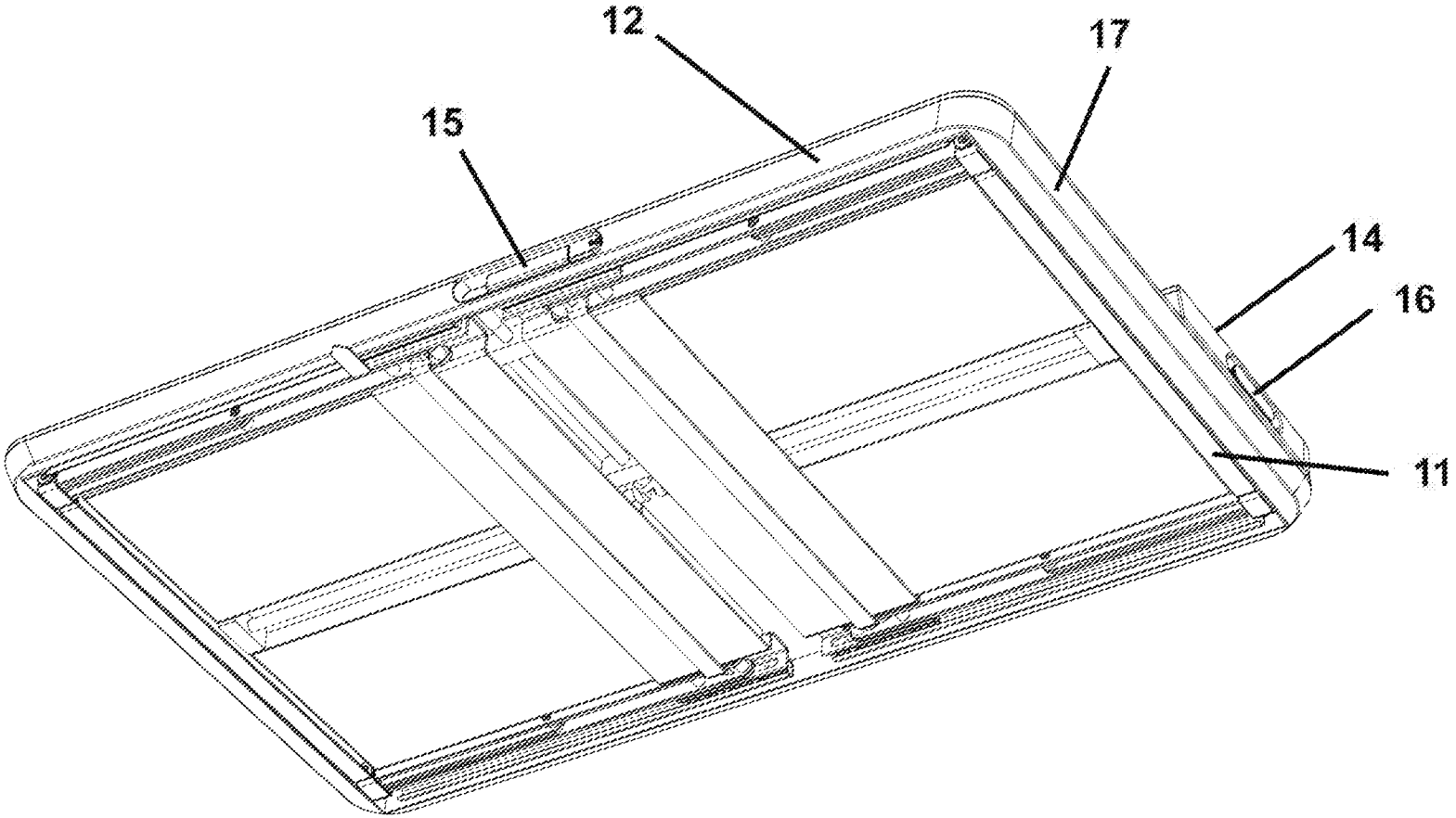
FIG. 2 is a bottom perspective view of the desk mountable workstation in the folded configuration.
Figure 3:
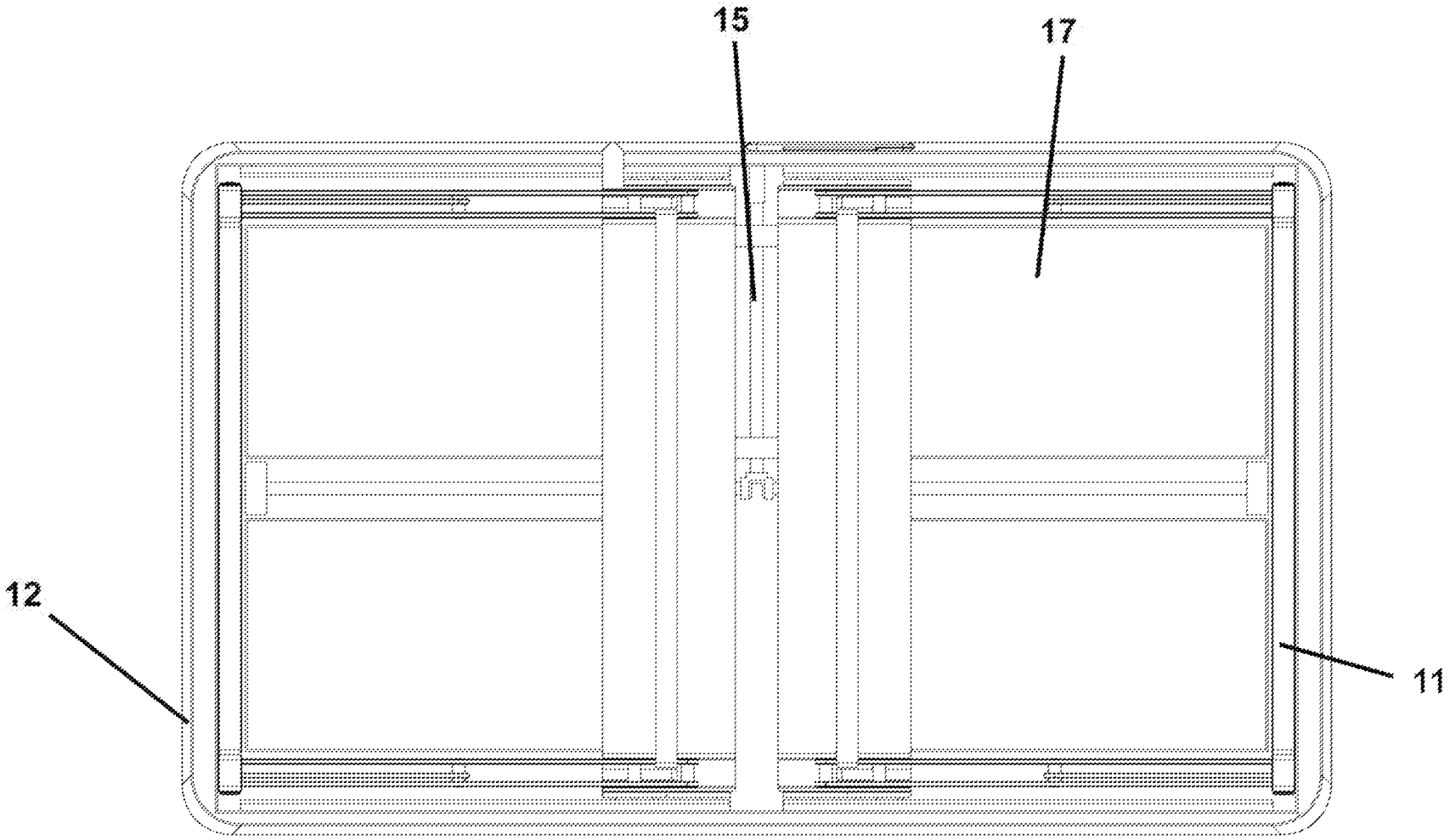
FIG. 3 is a bottom plan view of the desk mountable workstation in the folded configuration.
Figure 4:
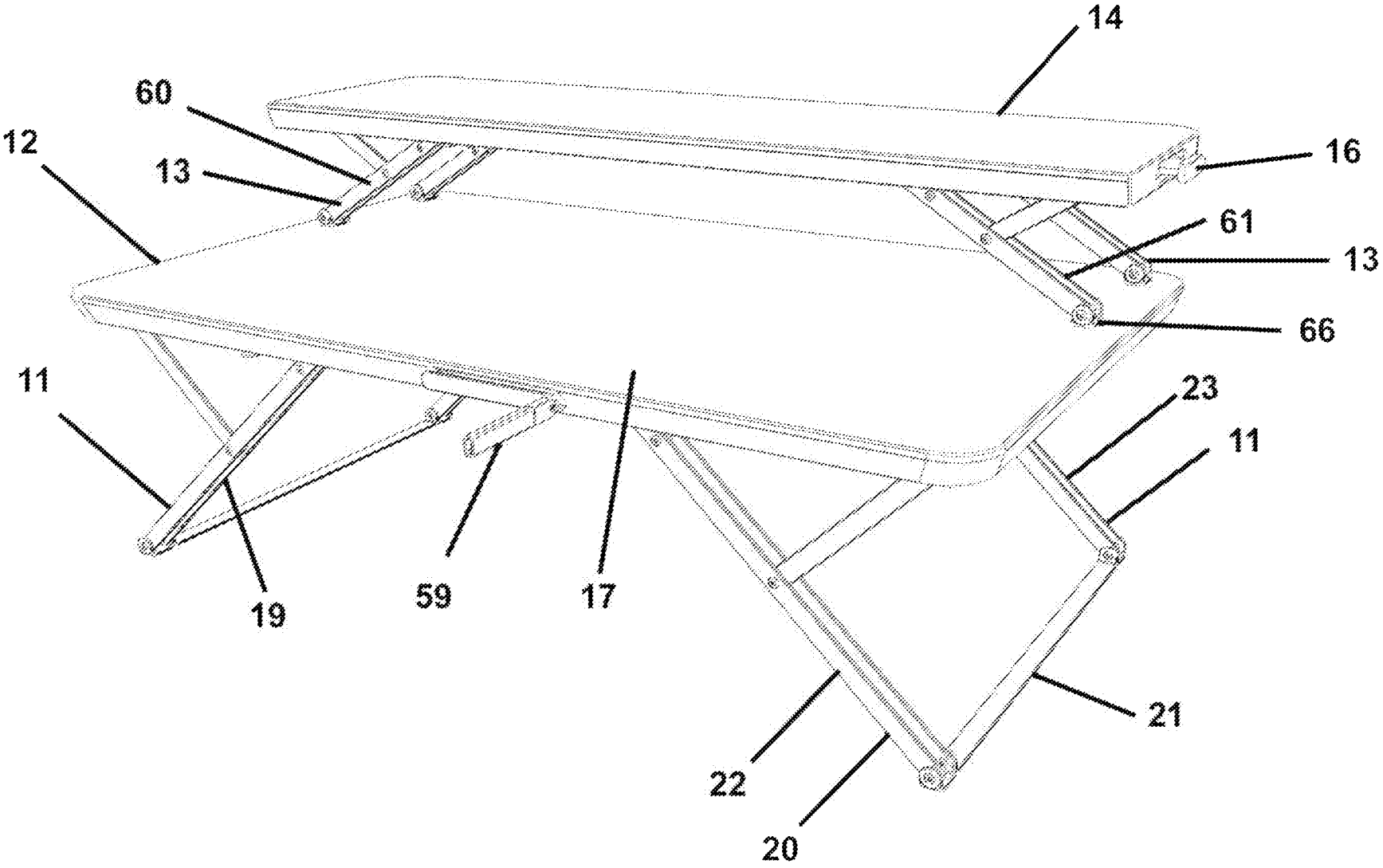
FIG. 4 is a top perspective view of the desk mountable workstation in a semi-open configuration.
Figure 5:
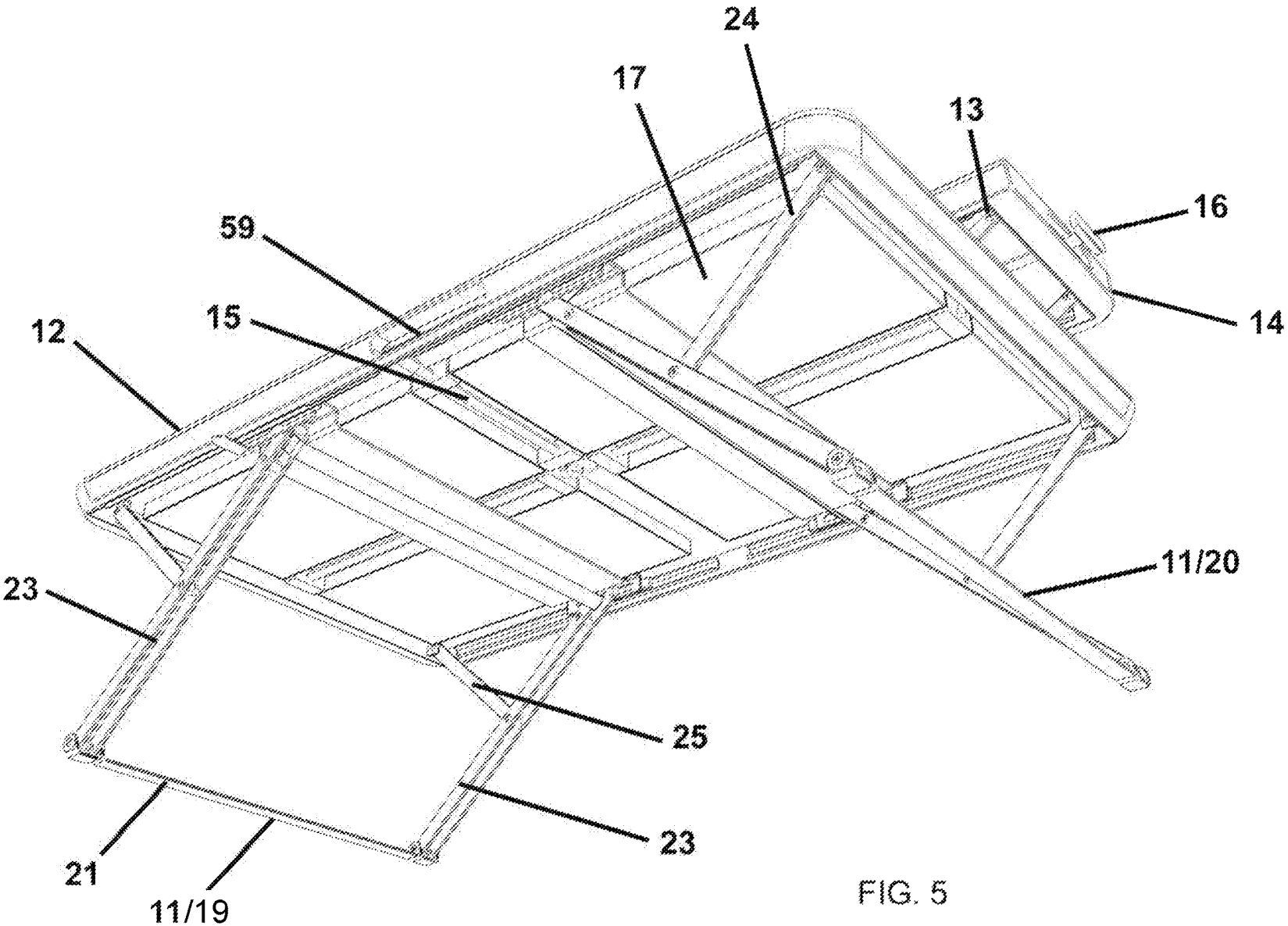
FIG. 5 is a bottom perspective view of the desk mountable workstation in the semi-open configuration.
Figure 6:
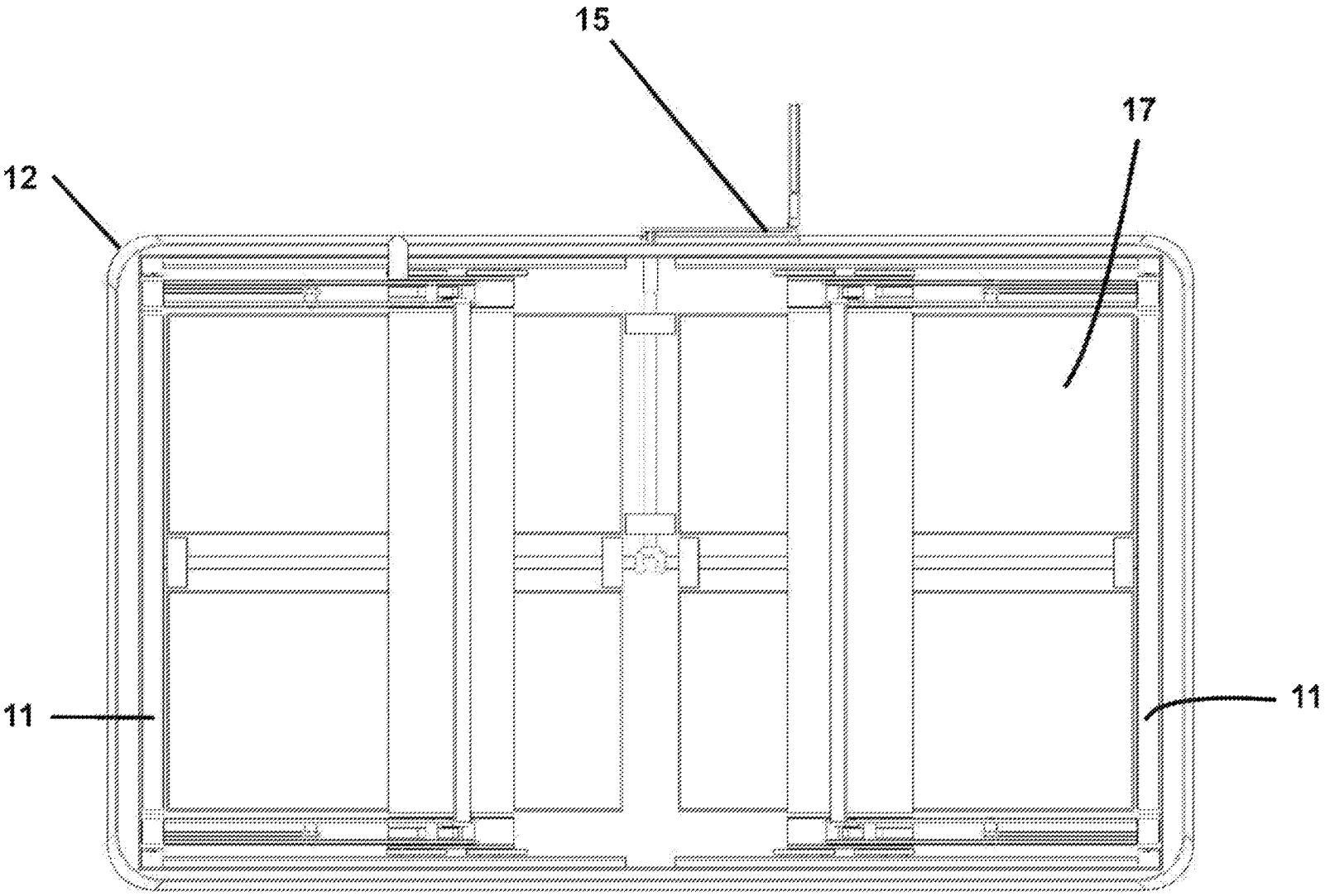
FIG. 6 is a bottom plan view of the desk mountable workstation in the semi-open configuration.
Figure 7:
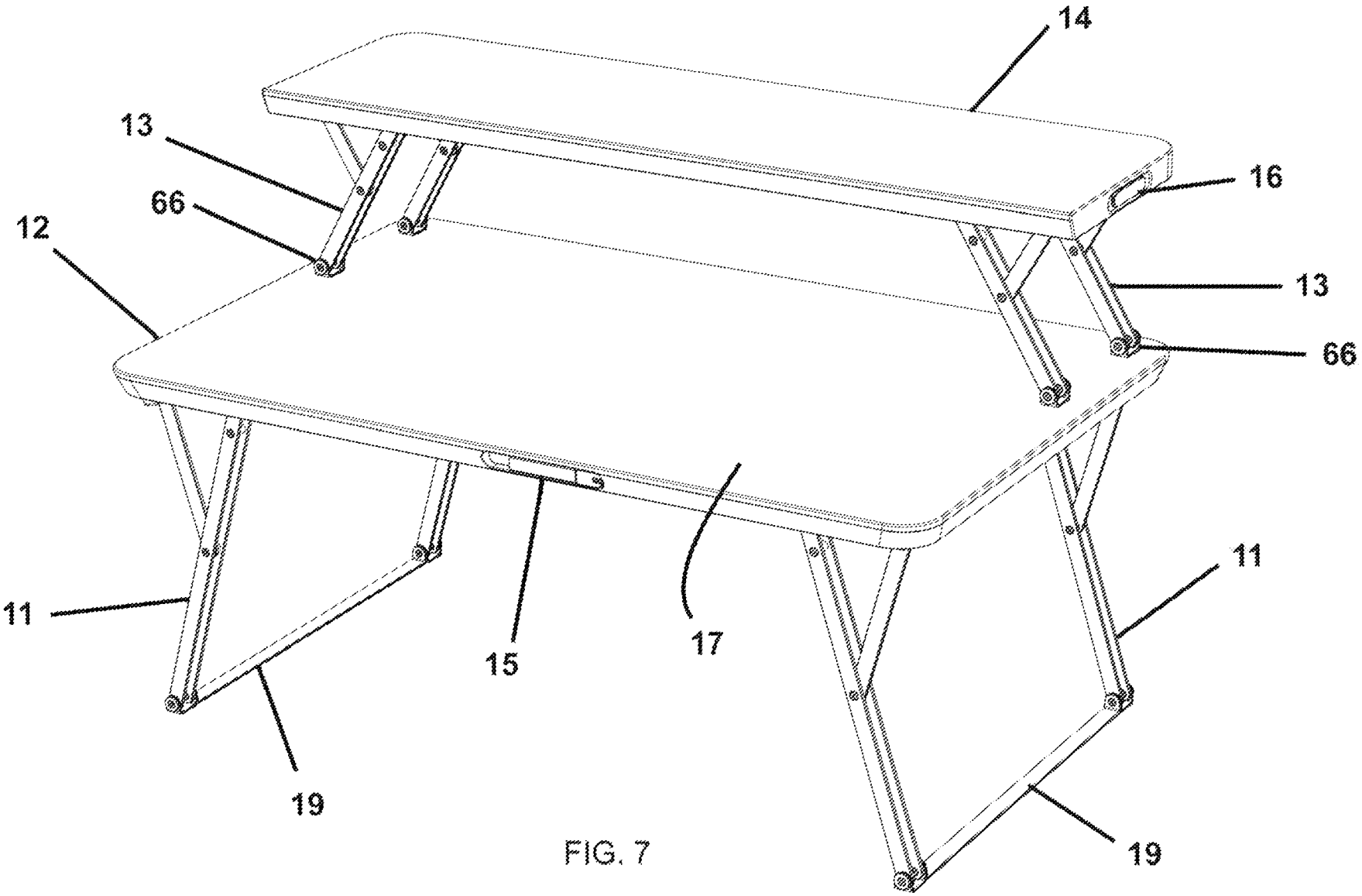
FIG. 7 is top perspective view of the desk mountable workstation in a fully open configuration.
Figure 8:
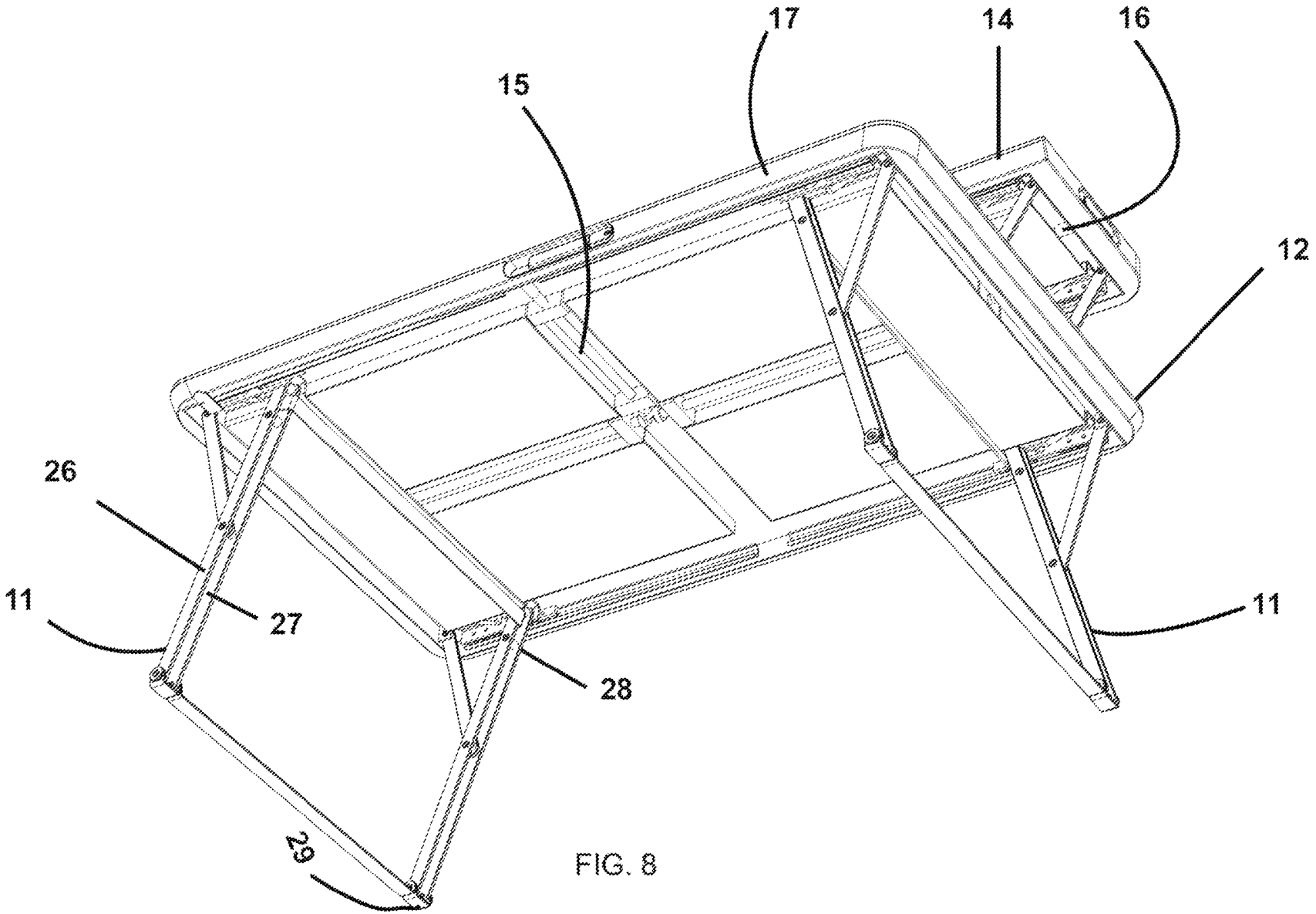
FIG. 8 is a bottom perspective view of the desk mountable workstation in the fully open configuration.
Figure 9:
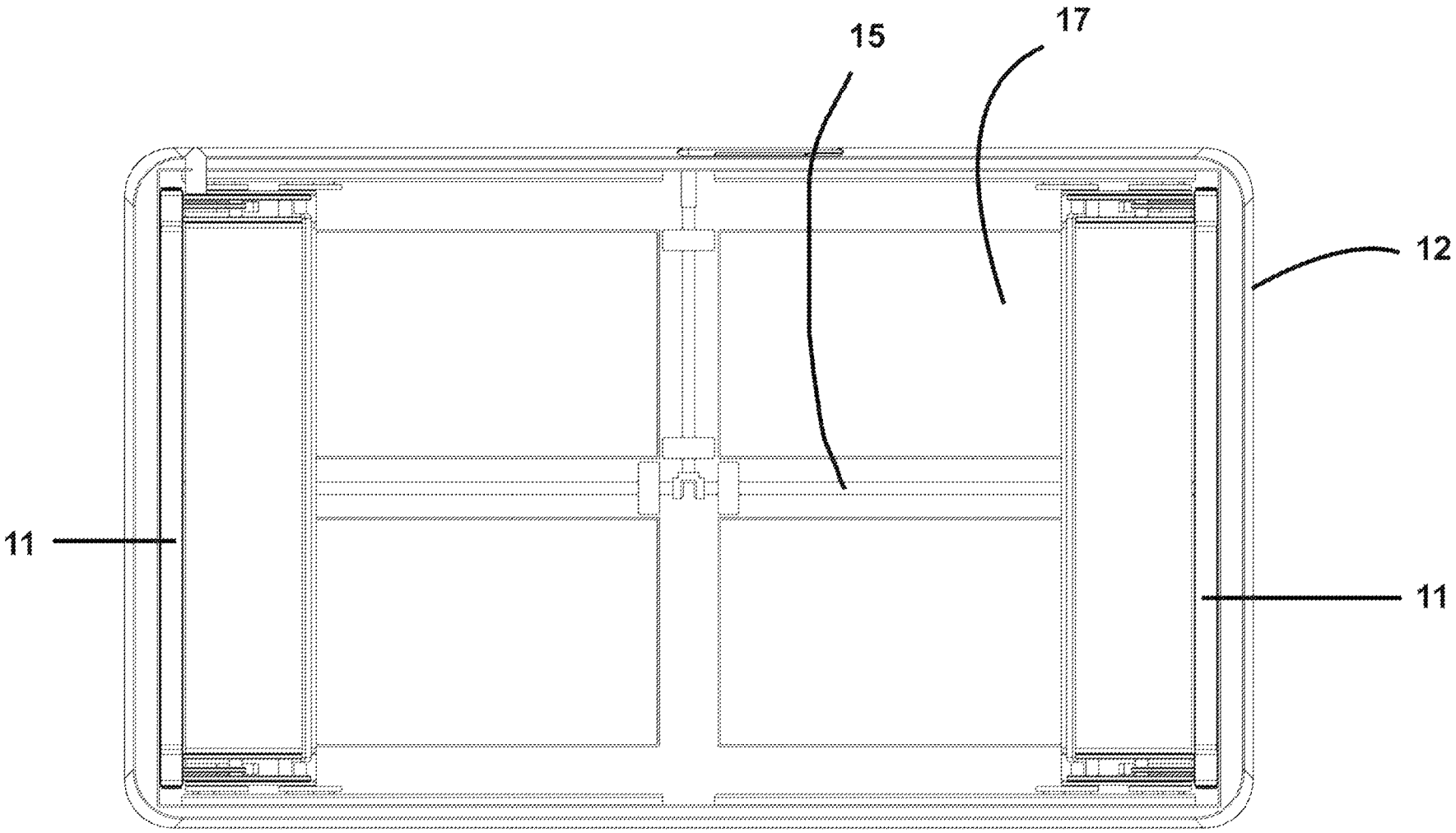
FIG. 9 is a bottom plan view of the desk mountable workstation in the fully open configuration.

Referring now to FIGS. 1 to 9, there is shown a first version of a desk mountable workstation, generally designated 10, being continuously movable or adjustable between a fully closed or flat configuration as shown in FIGS. 1 to 3, an intermediate or part open configuration as show in FIGS. 4 to 6, and a fully open or extended configuration as shown in FIGS. 7 to 9.

The workstation 10 comprises an adjustable lower support structure 11 for mounting or seating on a desk top, a lower platform 12 mounted on the lower support structure 11, an adjustable upper support structure 13 mounted atop the lower platform 11, and an upper platform 14 mounted on the upper support structure 13. Further, the workstation 10 comprises a lower adjustment mechanism 15 for continuous adjustment of the lower support structure 11 and thereby the height of the lower platform 12 with respect to the desk top, and an upper adjustment mechanism 16 for continuous adjustment of the upper support structure 13 and thereby the height of the upper platform 14 with respect to the lower platform.

The lower platform 13 comprises a rectangular timber panel 17 or table top with rounded corners and bevelled edges as shown. Similarly, the upper platform 14 comprises a timber panel 18 or table top with rounded and bevelled edges as shown. The upper platform 14 is of similar length to the lower timber panel/lower platform, but is only approximately one third to one half as wide from front to back as the lower timber panel/lower platform. The upper platform is located directly above a rear portion of the lower platform.

The lower support structure 11 comprises a left and right lower support portions, 19 and 20 respectively, configured as a mirror image of each other in a midline transverse plane. Each portion comprises a transverse base rod 21 extending from front to rear and interconnecting a lower front leg 23 and a lower rear leg 24.

Each lower leg, 22 and 23, comprises parallel lower front and rear rods, 26 and 27 respectively, interconnected with spacers 28, and ending distally by pivotal attachment to a foot bracket 29 (see also FIG. 12) mounted on the desk. A lower front strut 24 pivotally connects the lower front leg 22 to the lower platform 12, and a lower rear strut 25 pivotally connects the lower rear leg 23 to the lower platform 12.

Figure 10:
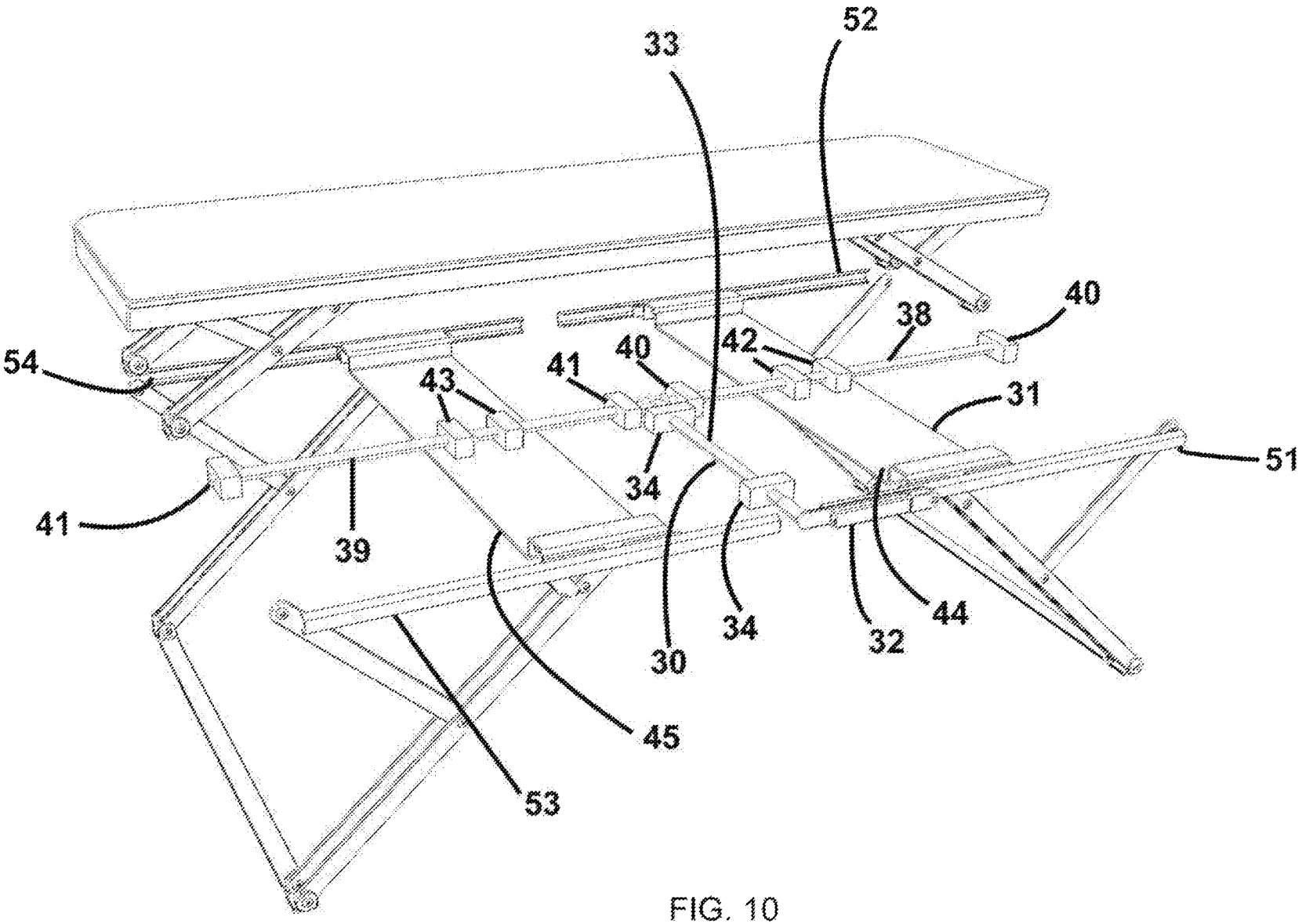
FIG. 10 is a top perspective view of the desk mountable workstation in the semi-open configuration with a lower platform removed.
Figure 11:
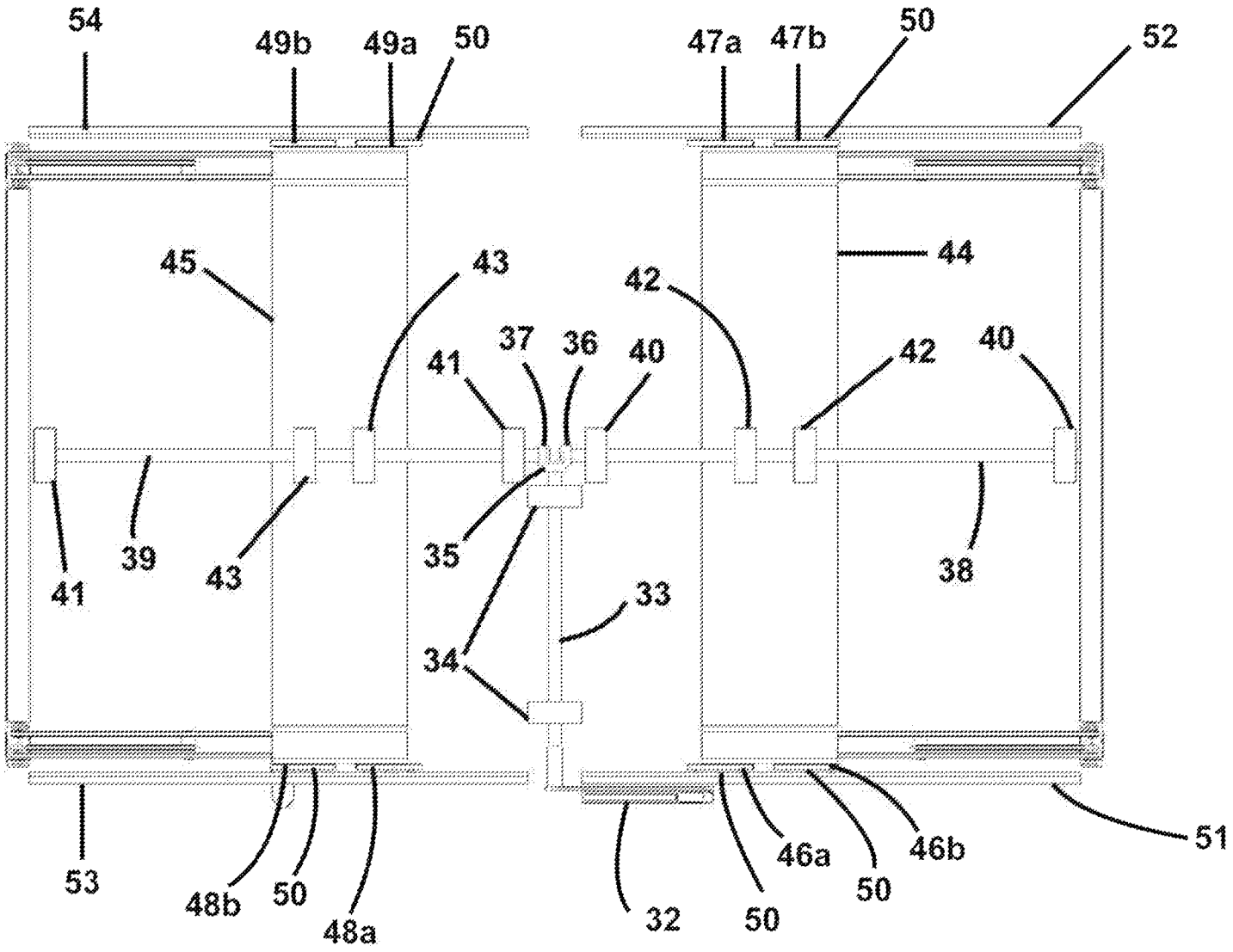
FIG. 11 is a top plan view of the lower adjustment mechanism and lower support structure of the desk mountable workstation in the semi-open configuration.
Figure 12:
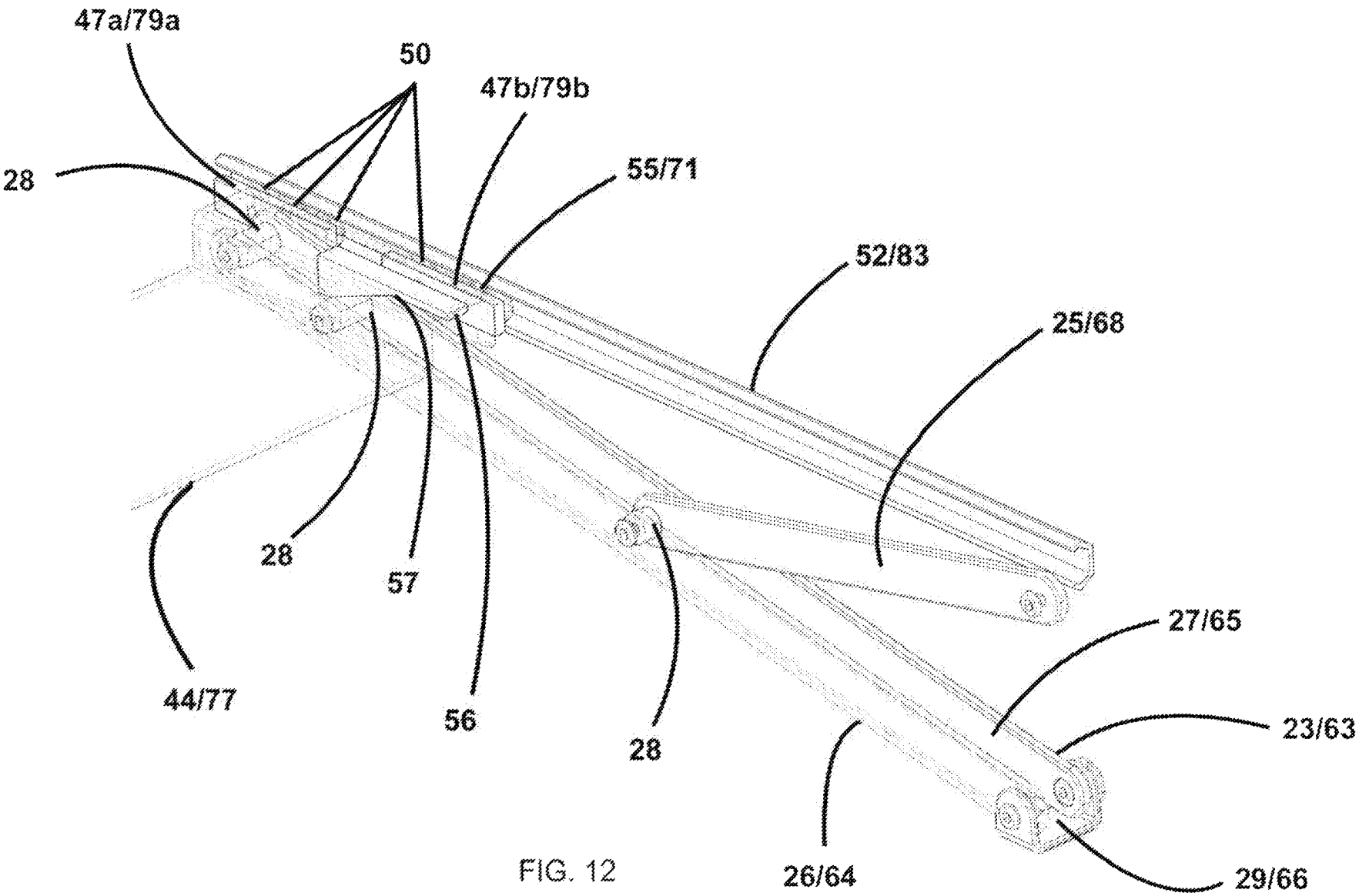
FIG. 12 is a diagrammatic perspective view illustrating running a lift initiation portion of the adjustment mechanism in respect of the lower or upper right rear leg of the workstation.
Figure 13:
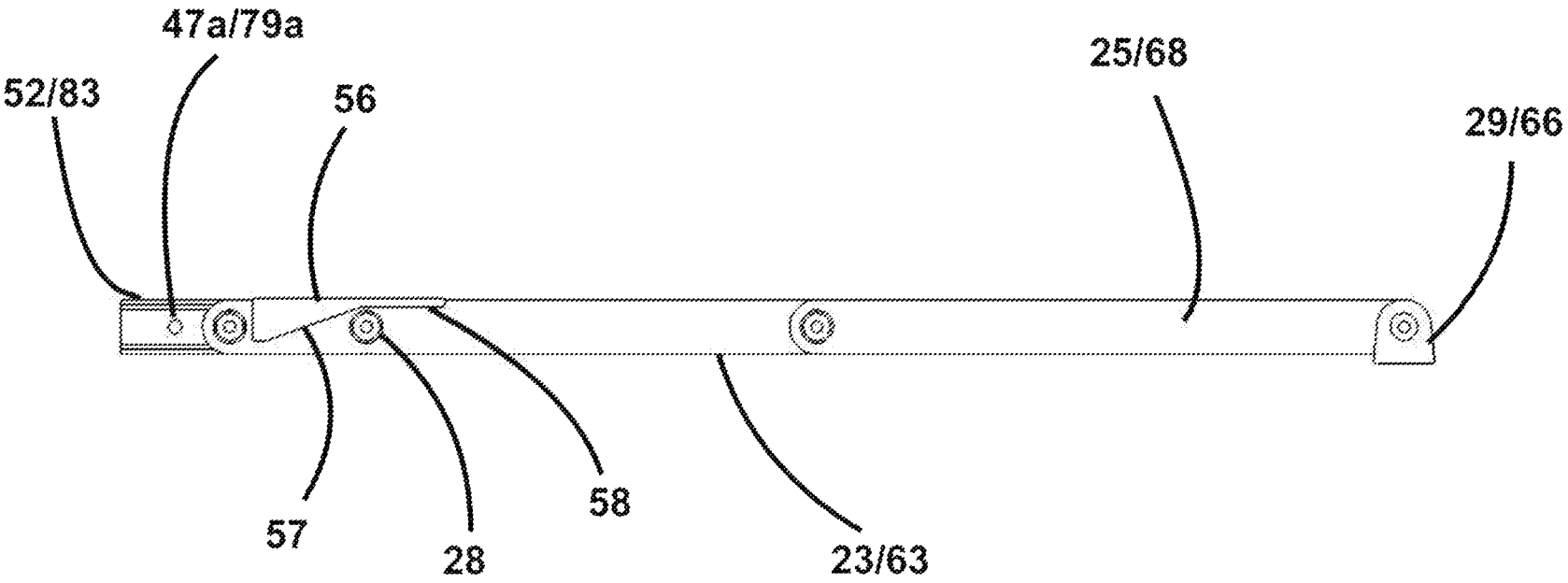
FIGS. 13 to 17 are a sequence of diagrammatic front side views illustrating operation of the lift initiation portion during extension of the lower/upper right rear leg, from zero degrees in FIG. 13, to ten degrees in FIG. 14, to twenty degrees in FIG. 15, to thirty degrees in FIG. 16, and finally to leg full extension in FIG. 17.
Figure 14:
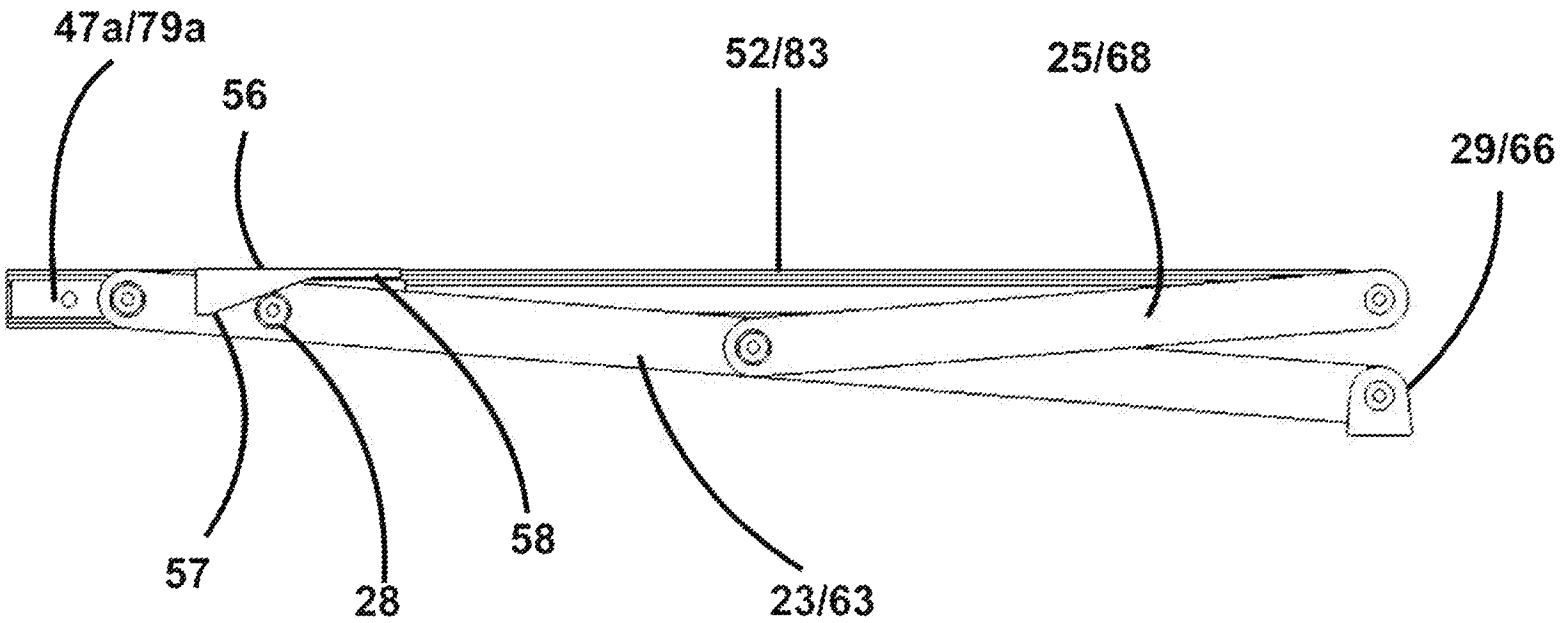
Figure 15:
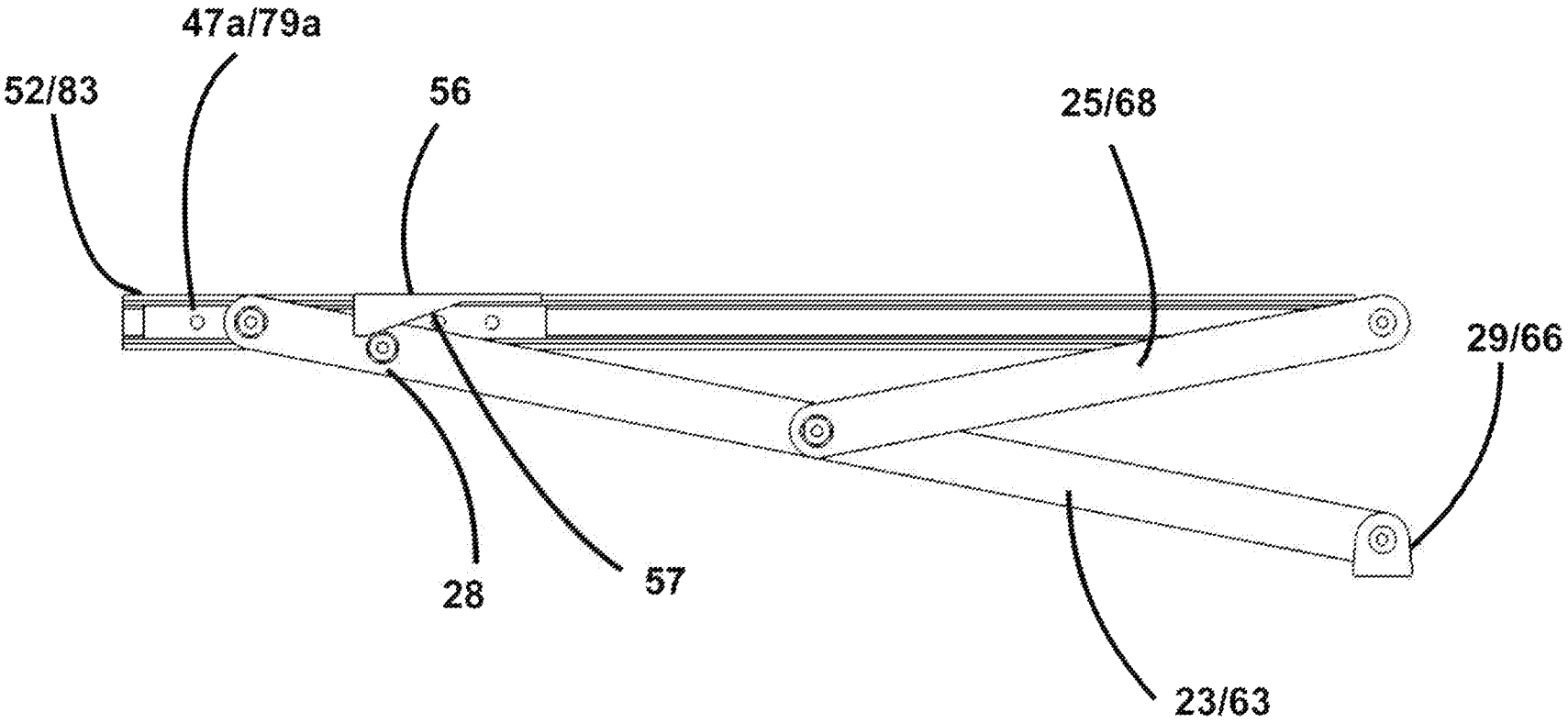
Figure 16:
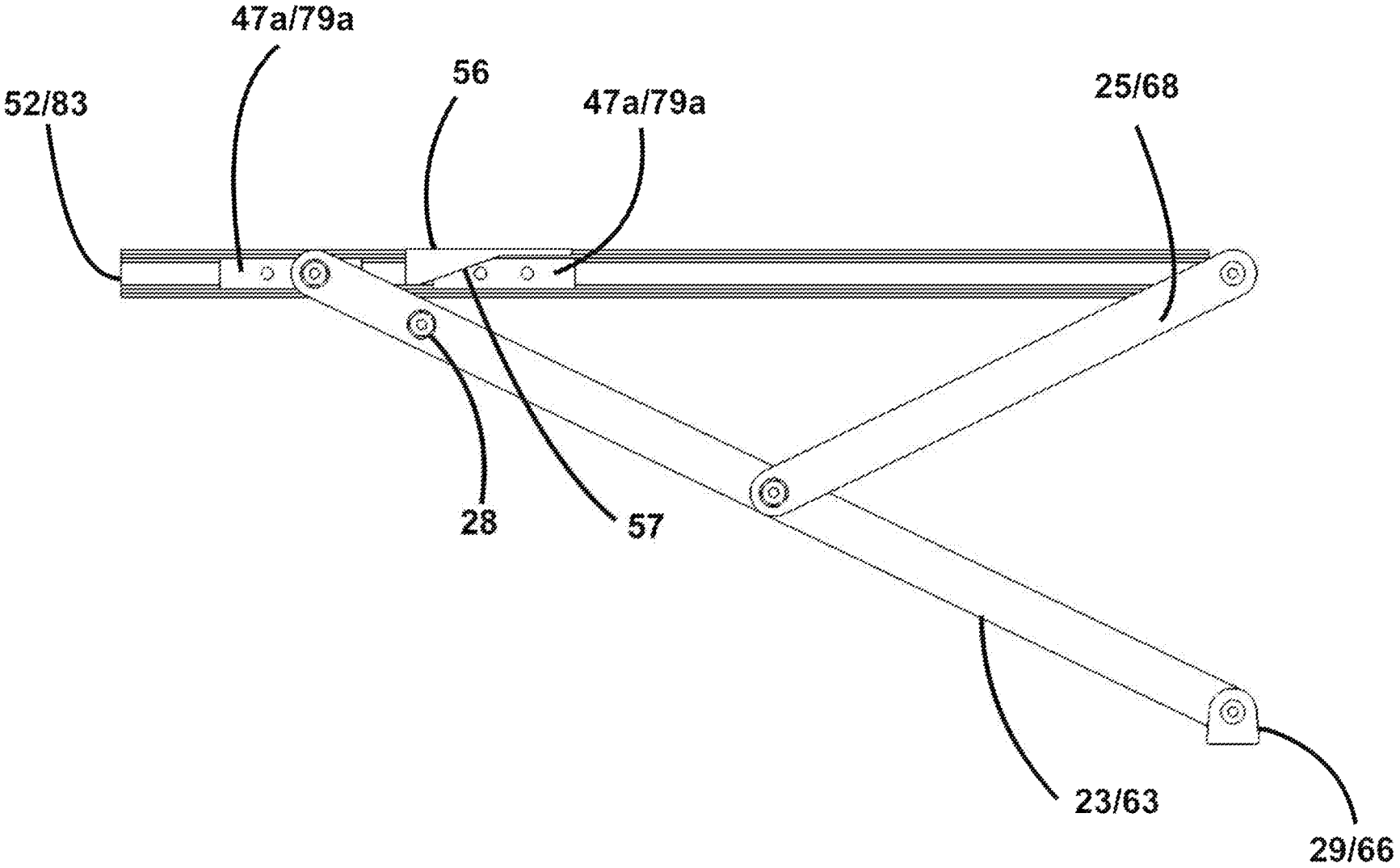
Figure 17:
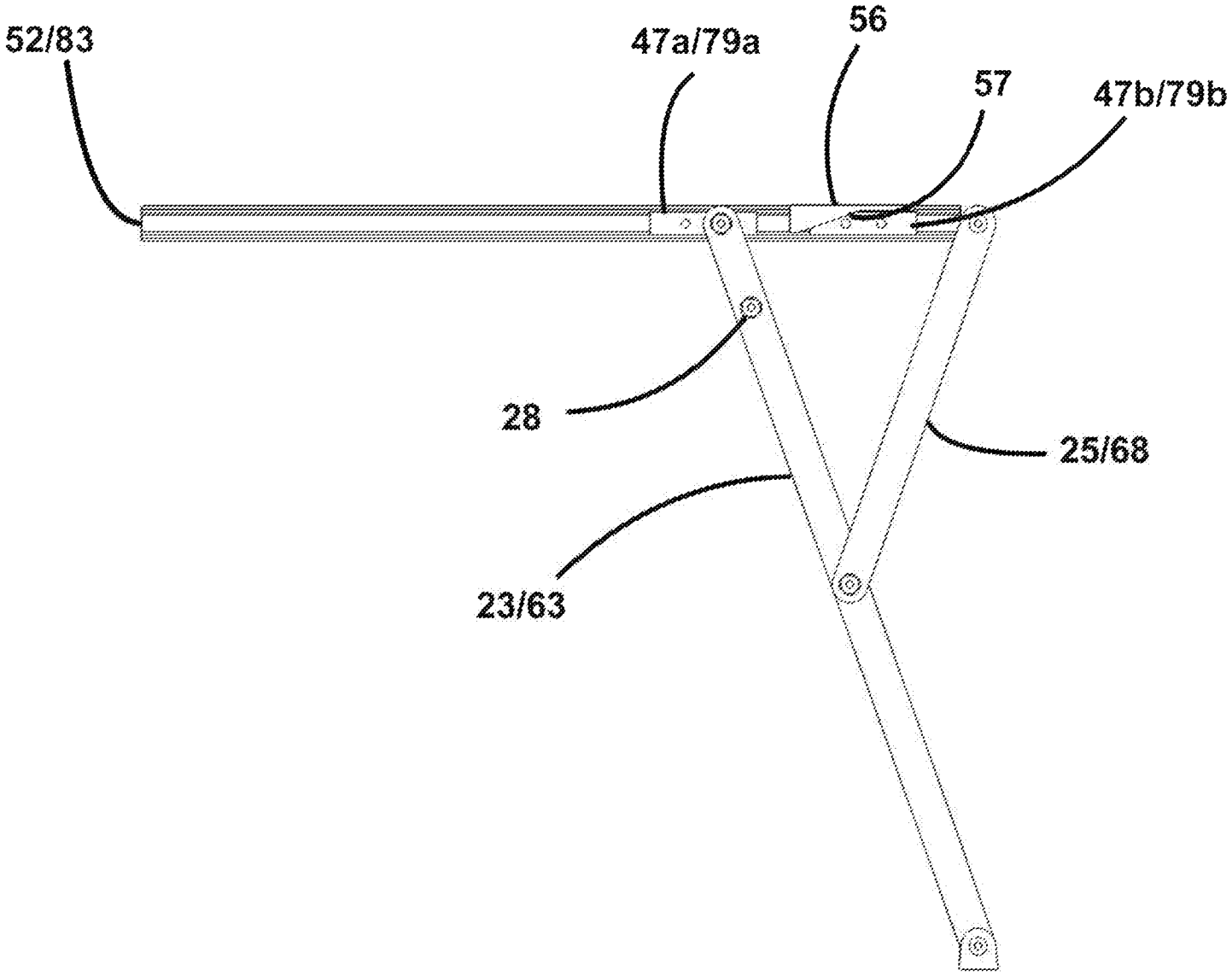
Figure 18:
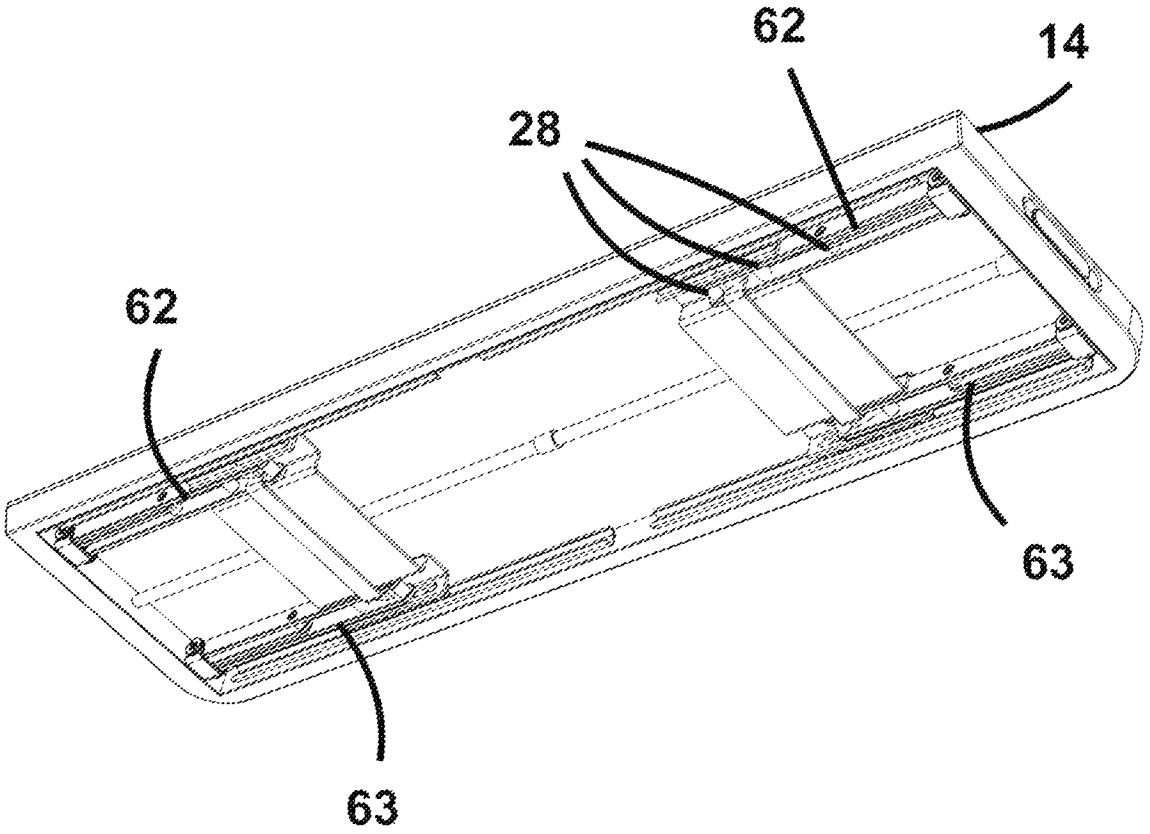
FIG. 18 is a bottom perspective view of an upper platform of the desk mountable workstation in the folded configuration.
Figure 19:
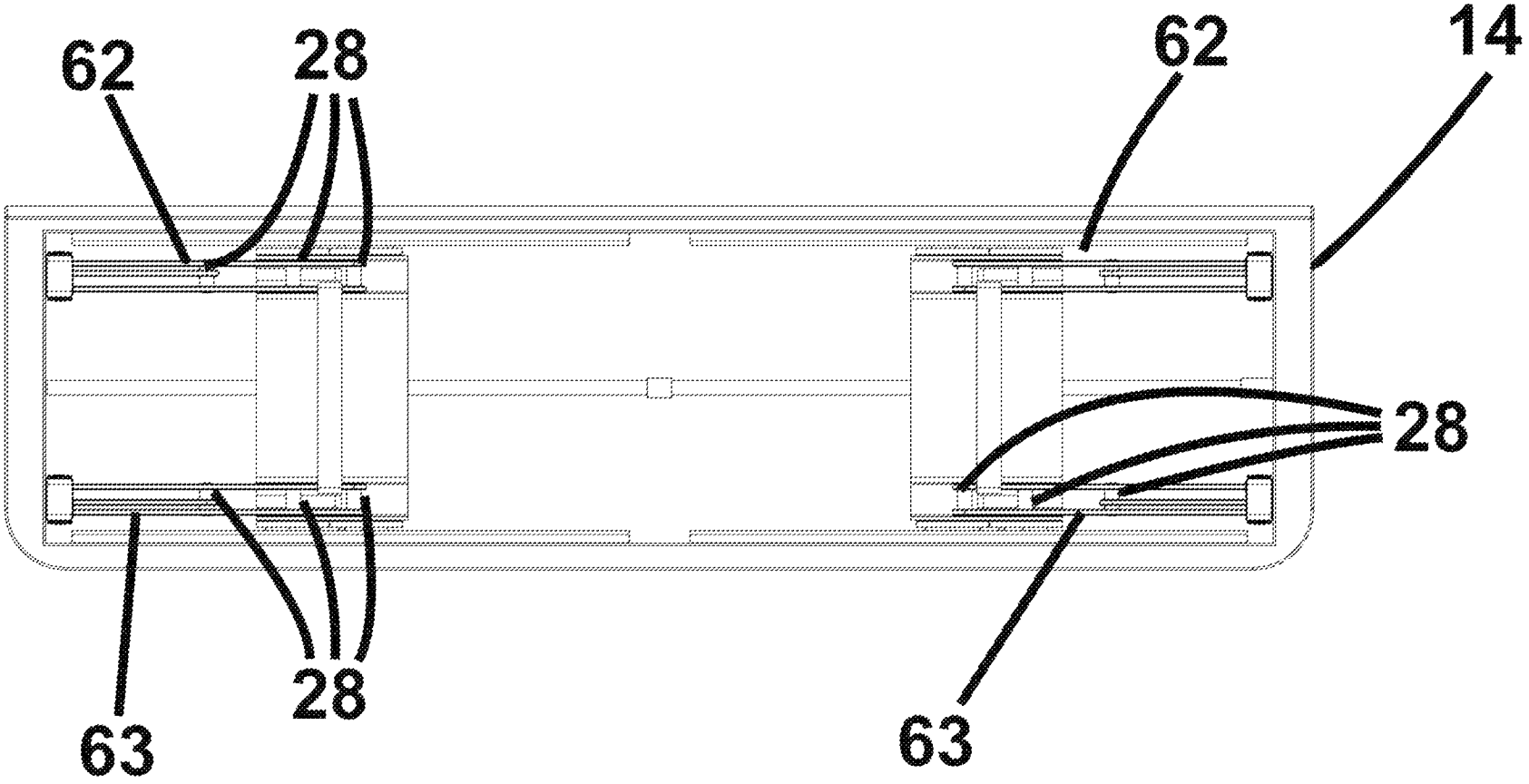
FIG. 19 is a bottom plan view of the upper platform in the folded configuration.
Figure 20:
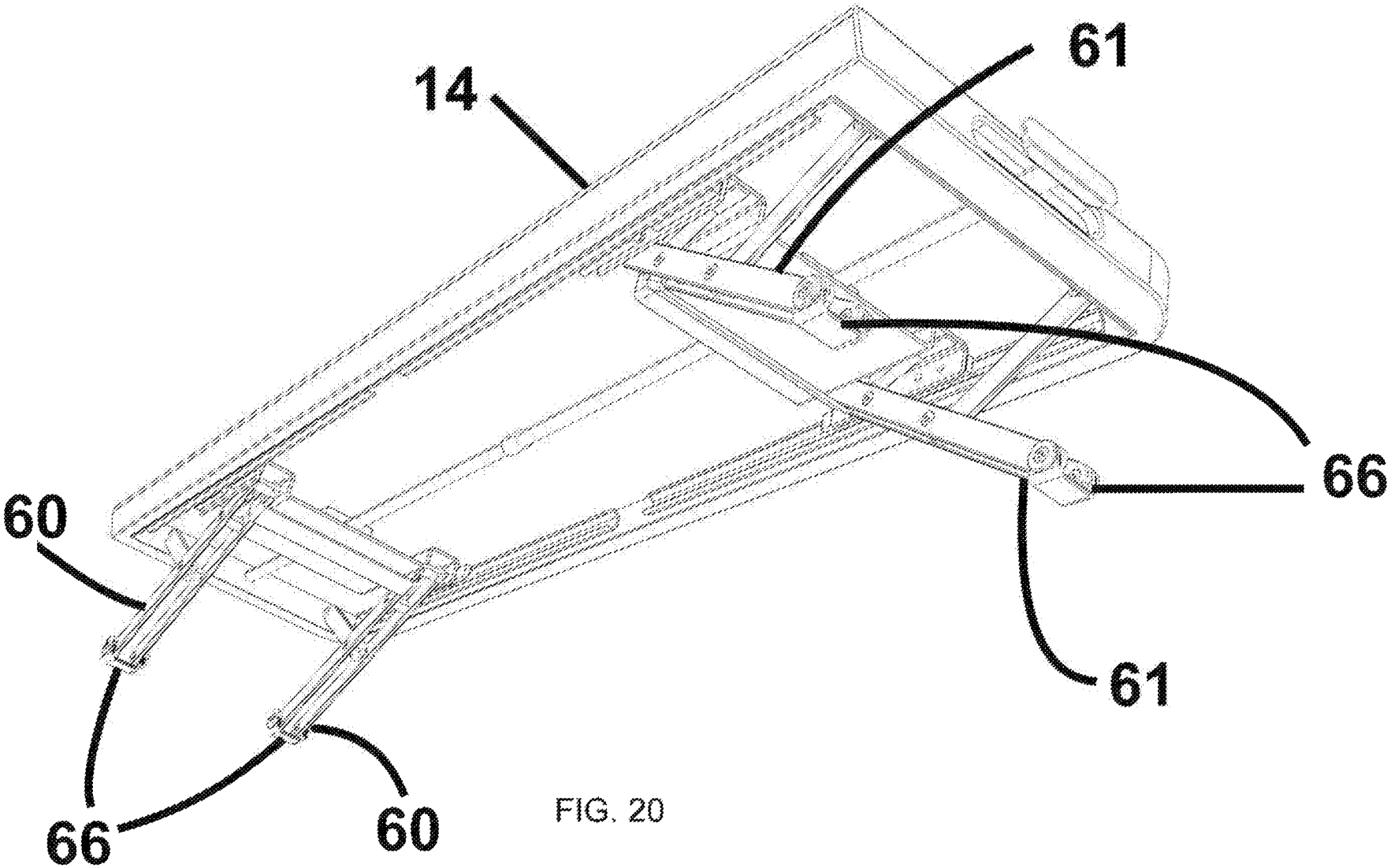
FIG. 20 is a bottom perspective view of the upper platform in the semi-open configuration.
Figure 21:
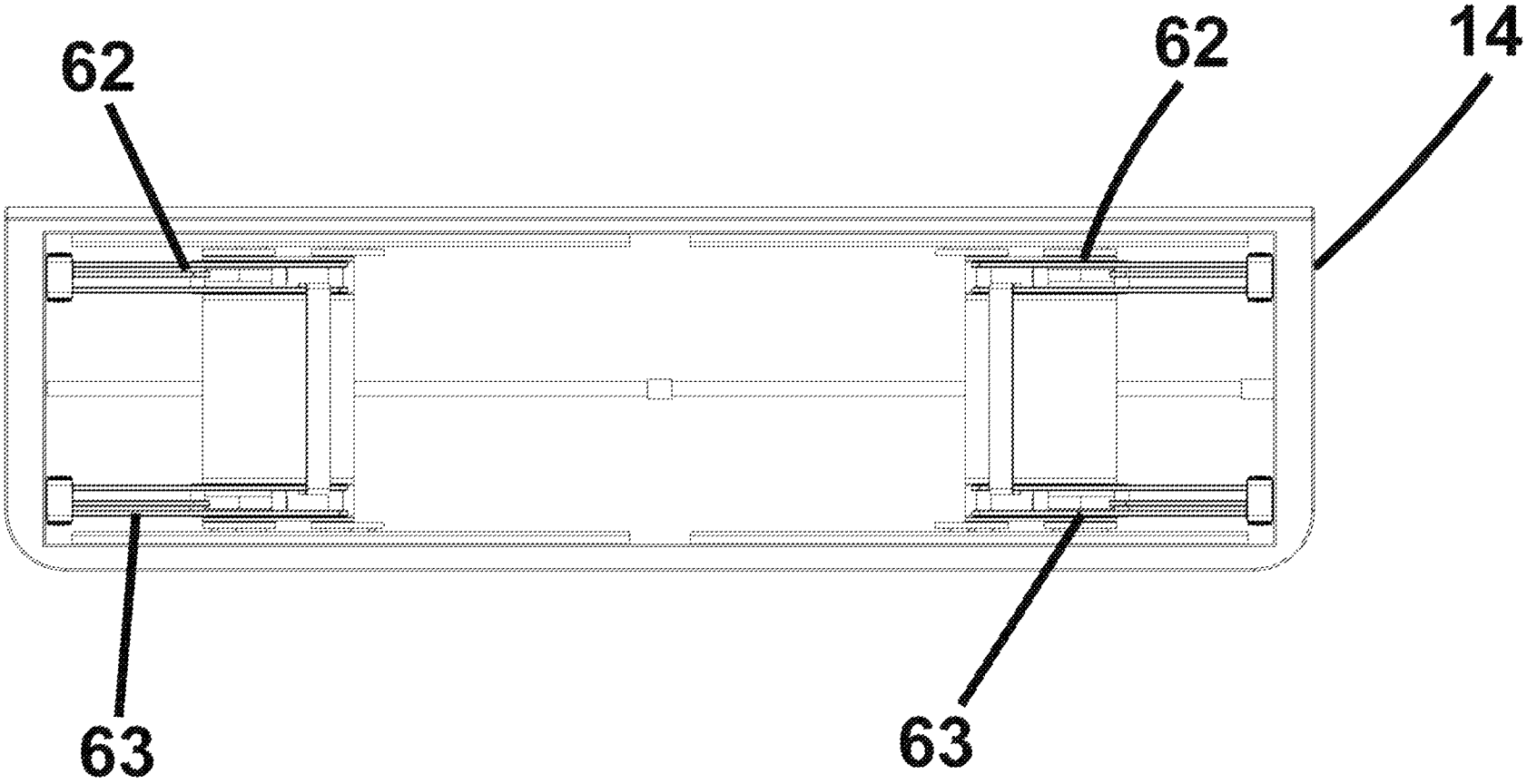
FIG. 21 is a bottom plan view of the upper platform in the semi-open configuration.
Figure 22:
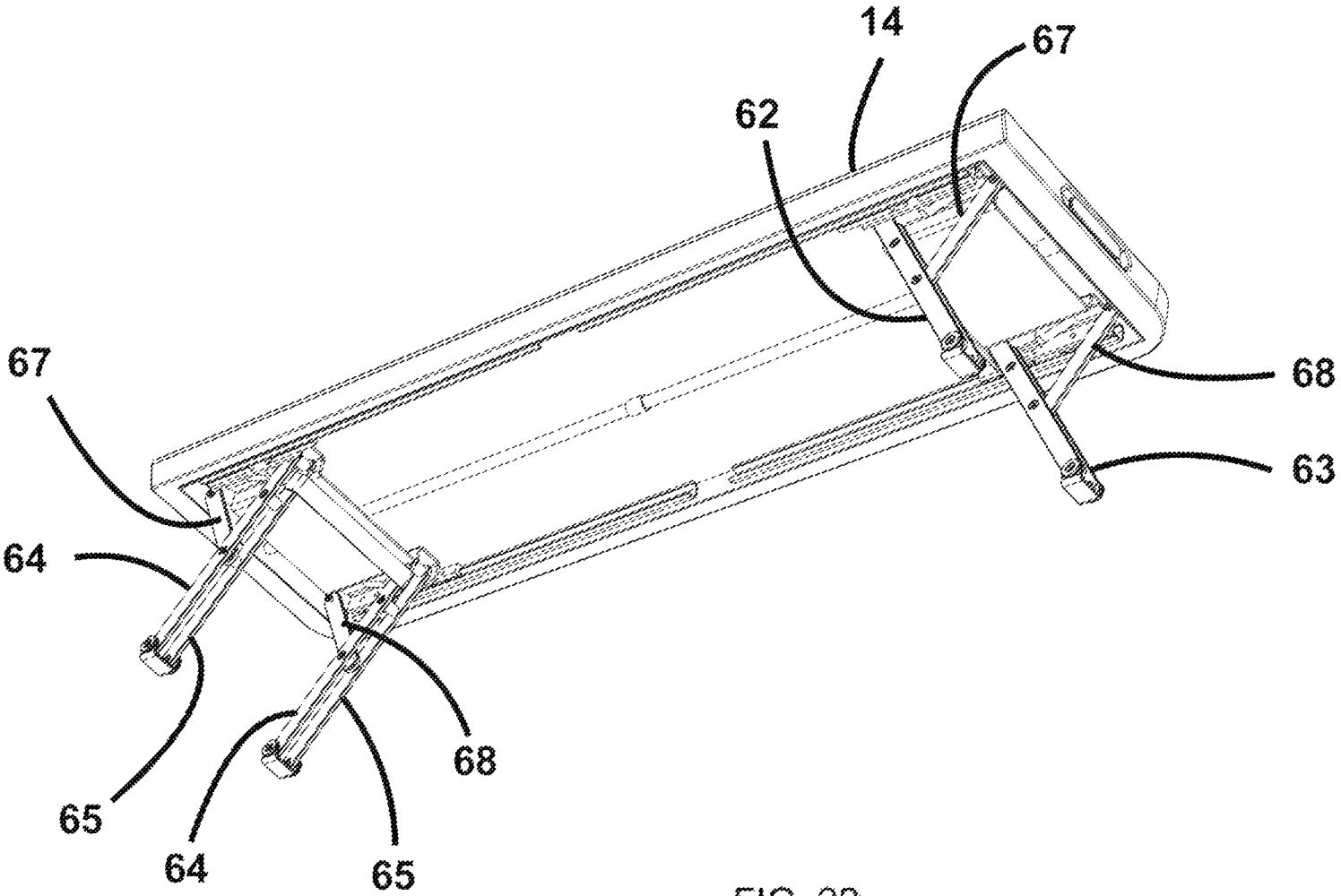
FIG. 22 is a bottom perspective view of the upper platform in the fully open configuration.
Figure 23:
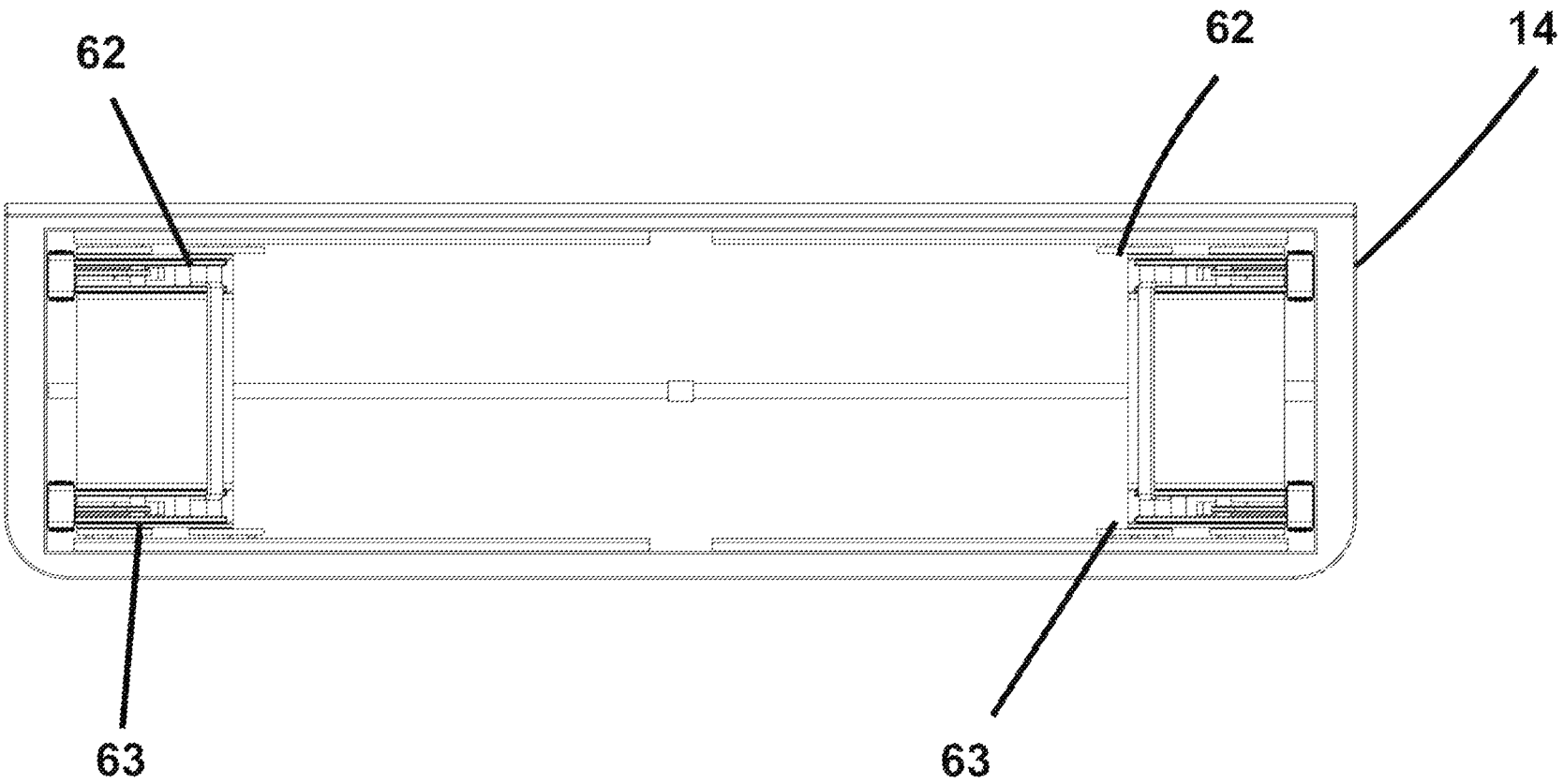
FIG. 23 is a bottom plan view of the upper platform in the fully open configuration.

Referring now to FIGS. 10 and 11, the lower adjustment mechanism comprises a lower rotating portion 30, a lower running portion 31, and a lower initial assist mechanism 55 (see FIG. 12). The rotating portion 30 comprises a foldable handle 32 connected with an elongate first screw member 33, the first screw member passing through and being anchored beneath the lower platform by a pair of first guide blocks 34, and ending in a circular bevelled first gear 35. Articulating perpendicularly with the first gear 35 are circular bevelled second and third gears, 36 and 37 respectively. The second gear 36 is secured to the end of an elongated second screw member 38 which extends away perpendicularly to the right of the first screw member 33, and the third gear 37 is secured to the end of an elongated third screw member 39 which extends away perpendicularly to the left of the first screw member. A pair of first guide blocks 40 is mounted beneath the lower platform 12 near opposite ends of the second screw member 38, receiving the second screw member therethrough. Similarly, a pair of second guide blocks 41 is mounted beneath the platform towards opposite ends of the third screw member 39, receiving the third screw member therethrough.

Figure 26:
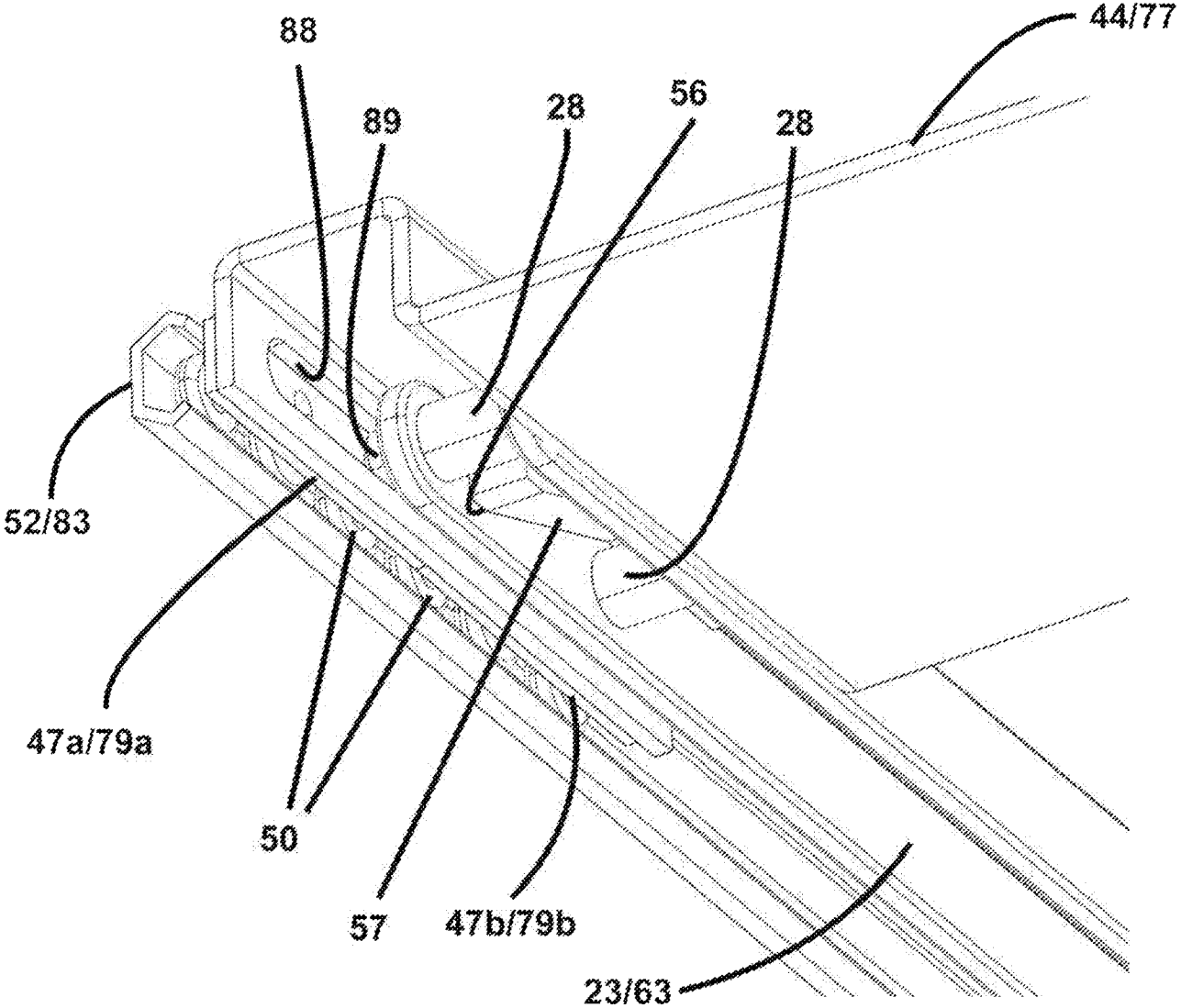
FIGS. 26 to 31 are a sequence of bottom perspective views illustrating operation of the lift initiation portion during extension of the lower/upper right rear leg from zero degrees in FIG. 26 out to around 45 degrees in FIG. 31.
Figure 27:
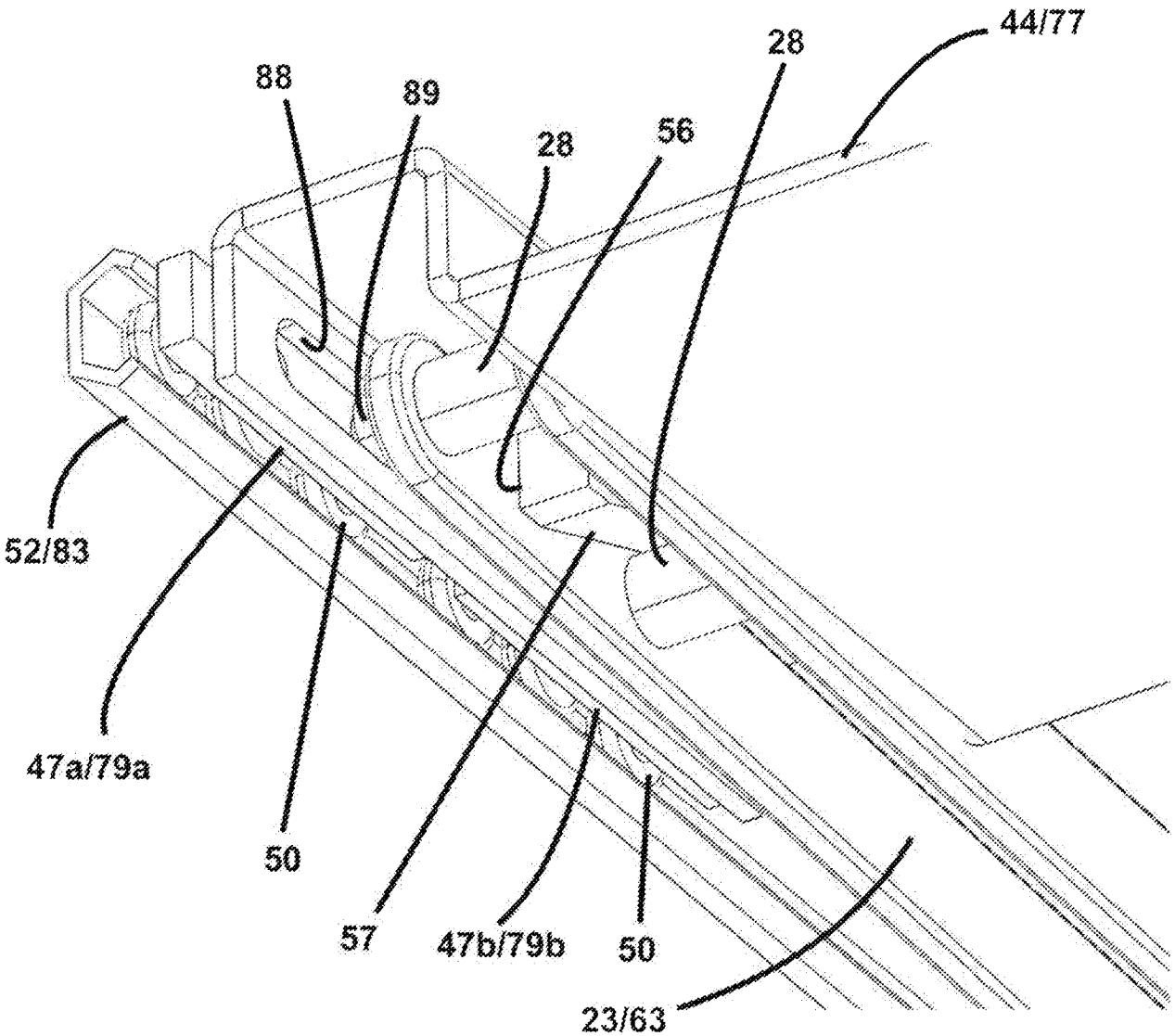
Figure 28:
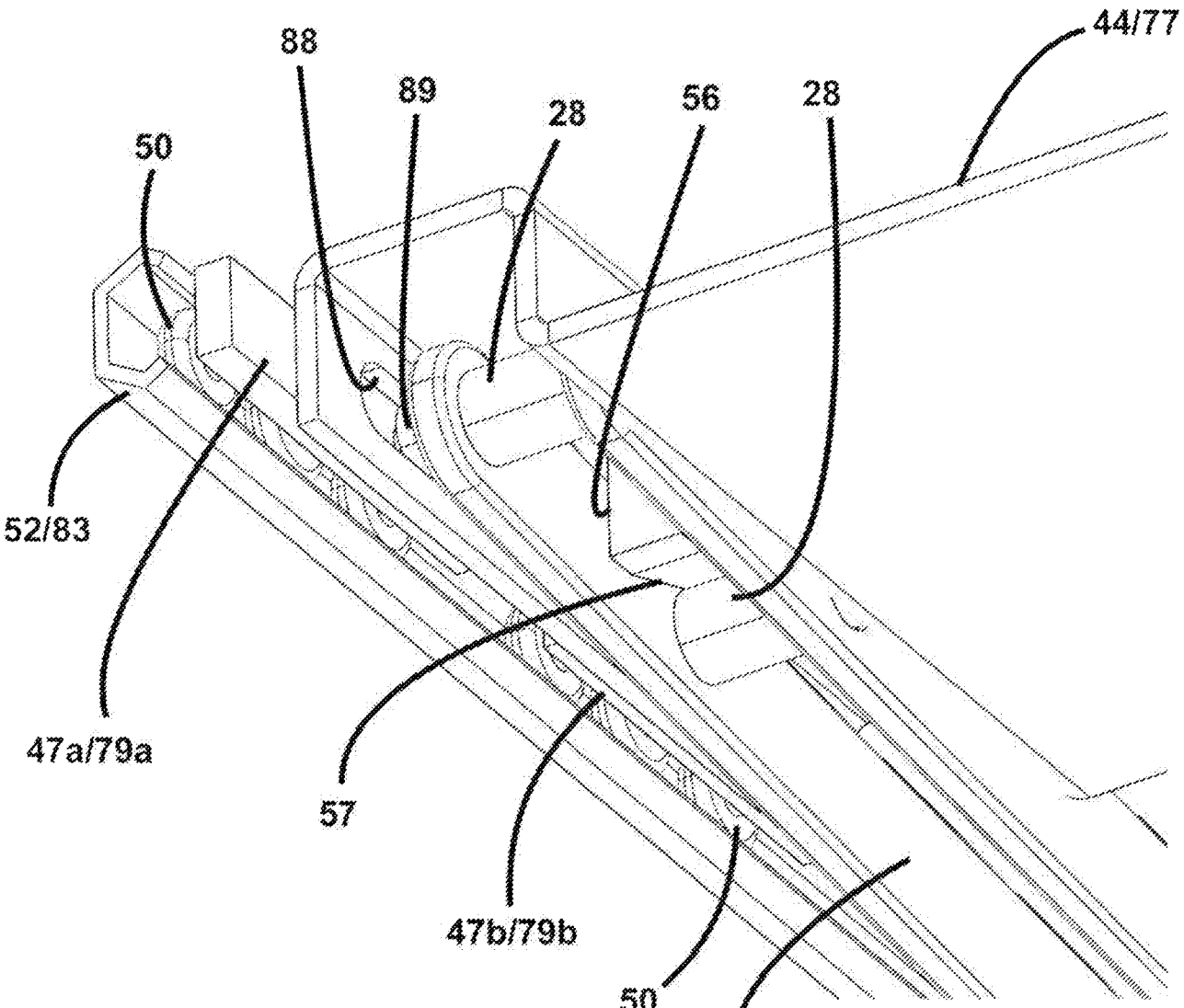
Figure 29:
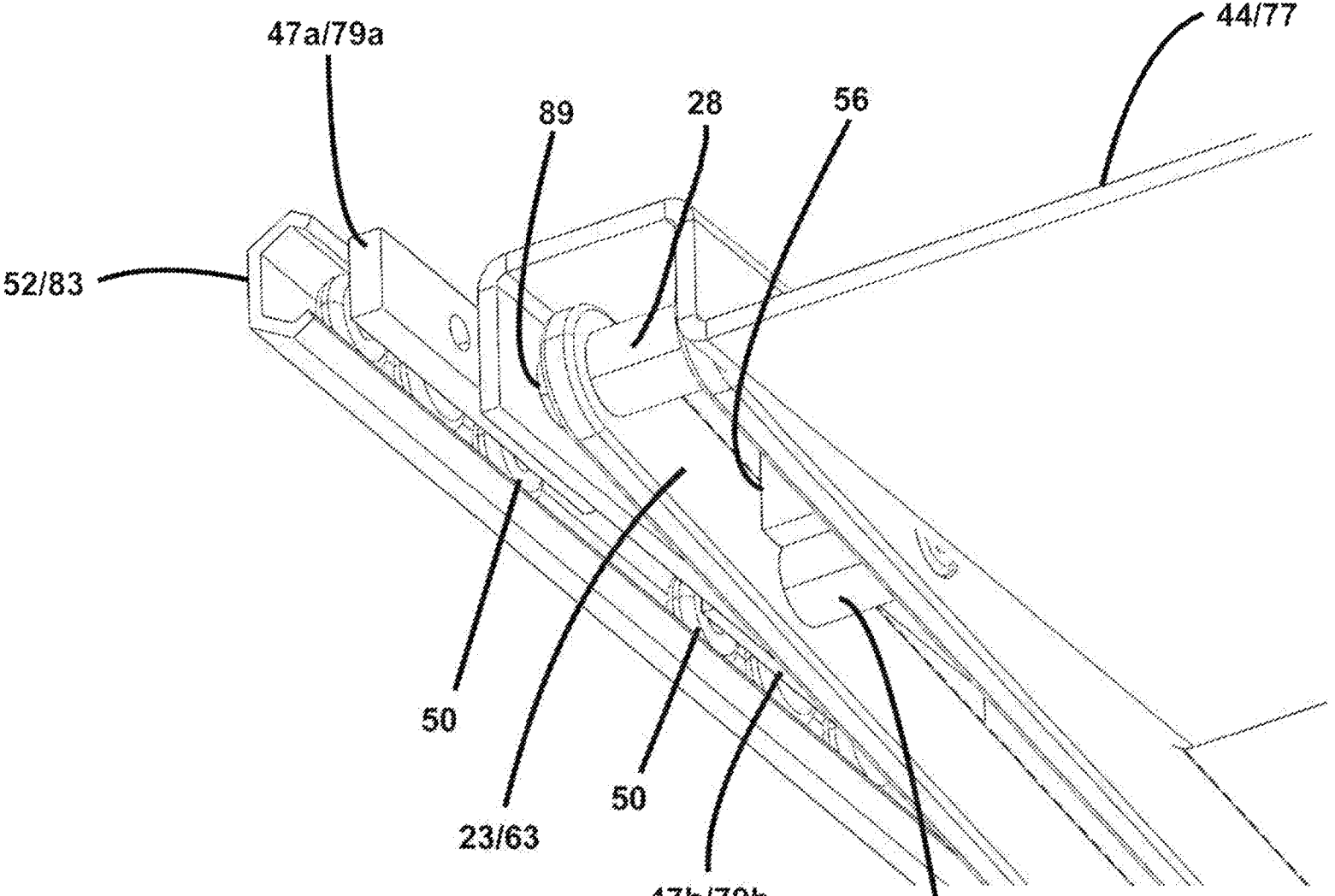
Figure 30:
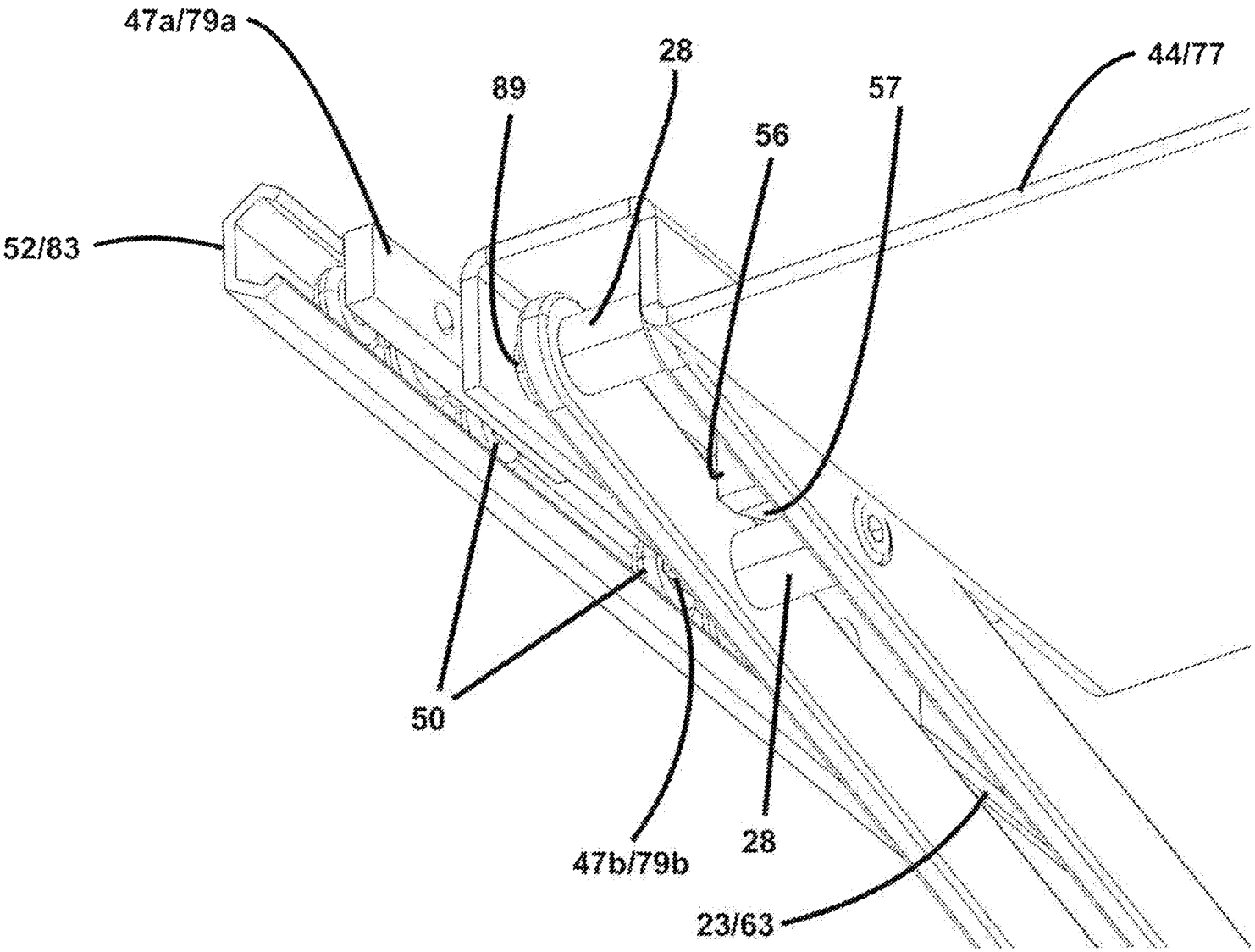
Figure 31:
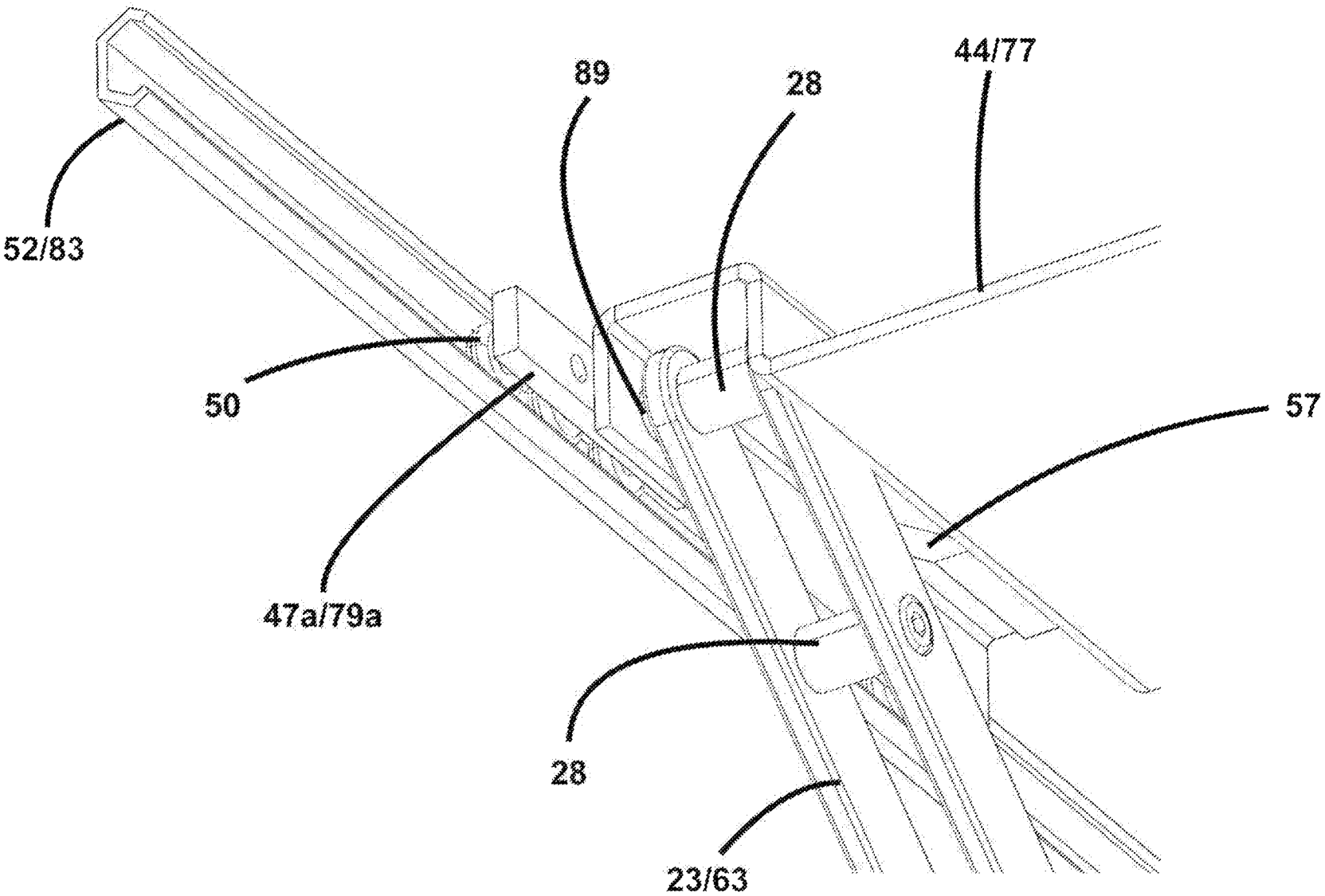

The running portion 30 of the lower adjustment mechanism comprises a pair of first running blocks 42 receiving the second screw member 38 therethrough, and a pair of second running blocks 43 receiving the third screw member 39 therethrough. The pair of first running blocks 42 is fixedly mounted on and moves horizontally with a first transverse plate 44. Similarly, the pair of second running blocks 43 is fixedly mounted on and moves horizontally with a second transverse plate 45. A linear elongated slot 88 with rounded ends (see FIG. 26) is defined in the outer wall of an inverted U-shaped end of the first lower transverse plate 44. In fact, there are four slots 88, one in each of the vertical front and rear walls of each of the first and second lower transverse plates, 44 and 45 respectively.

Attached to the front inverted U-shaped end of the first transverse plate 44 is a lateral or outer first front wheel bracket 46*b*, and attached to the rear inverted U-shaped end of the first transverse plate 44 is a lateral or outer rear first wheel bracket 47*b*. Medial to each of the outer first lower wheel brackets, 46*b* and 47*b* respectively, are inner or medial first wheel brackets, 46*a* and 47*a*. Similarly, attached to the front inverted U-shaped end of the second transverse plate 45 is a lateral or outer front second wheel bracket 48*b*, and attached to the rear inverted U-shaped end of the second transverse plate 45 is a lateral or outer rear second wheel bracket 49*b*. Medial to each of the outer second wheel brackets, 48*b* and 49*b* respectively, are inner or medial first wheel brackets, 48*a* and 49*a*. A pin 89 passing through the most medial, inner or upper spacer of each lower leg, and projecting through its respective slot 88, pivotally or rotatably connects each lower leg to its respective inner medial wheel bracket. Each of the front and rear, first and second wheel brackets has a line of three wheels 50 mounted thereon (see also FIG. 12). The wheels 50 of the pair of front first wheel brackets 46 roll or run in a C-shaped front first channel 51 which is secured peripherally about the underside of the lower platform, whilst the wheels 50 of the pair of rear first wheel brackets 47 roll or run in a C-shaped rear first channel 52 which is secured peripherally about the underside of the lower platform. Similarly, the wheels 50 of the pair of front second wheel brackets 48 roll or run in a C-shaped front second channel 53 which is secured peripherally about the underside of the lower platform, whilst the wheels 50 of the pair of rear second wheel brackets 49 roll or run in a C-shaped rear first channel 54 which is secured peripherally about the underside of the lower platform.

Referring to FIG. 12, there is shown part of the lower initial assist mechanism 55 comprising a swing member consisting of a partially wedge shaped block 56 which is fixed to and projects down from the underside of roof of the inverted U-shaped end of the transverse plate 44. The wedge block 56 has a ramped undersurface 57, angled at about forty five degrees, and which continues into a flat undersurface 58. In fact, the lower initial assist mechanism comprises four lower wedge blocks 56, one for engagement with the second most medial spacer of each lower leg during the initial phase of opening.

In order to manually raise the height of the lower platform 12, a user retracts and folds out a grasping segment 59 of the handle 32. The user then grasps segment 59 and rotates the handle in a clockwise direction. The clockwise rotation of the handle 32 in turn causes clockwise rotation of the first screw member 33 and its first bevelled gear wheel 35. The rotating first gear's articulation with the second and third bevelled gear wheels, 36 and 37 respectively, causes clockwise rotation of the second and third gears and their respective second and third screw members, 38 and 39 respectively. Unlike the fixed guide blocks which are unmoved by rotation of the screw members therethrough, the first and second pairs of running blocks, 42 and 43 respectively, move laterally out along their respective rotating second and third screw members. Being affixed to the first and second pairs of running blocks, the first and second transverse plates, 44 and 45 respectively, are moved laterally towards their respective sides of the lower platform 12. Concomitantly, the wheels 50 of the front and rear, first and second lateral wheel brackets, 46*b*, 47*b*, 48*b*, 49*b*, roll laterally outwards along and within the front and rear, first and second, channels, 51-54.

As shown in FIGS. 13 to 17 and 26 to 31, lateral movement of the transverse plates also results in concomitant lateral movement of respective wedge blocks 56. As each wedge blocks move laterally, its ramped undersurface 57 runs over the second most medial spacer 28 of the corresponding lower leg, thereby causing the second spacer to effectively run down the ramp during the first fifteen degrees or so of leg extension. As this occurs, the leg is forced to swing out, rotating about the leg's pivotal connection to its respective medial wheel bracket. Initially, whilst the ramp swings the lower leg out, the medial wheel bracket remains stationary until the medial end of the slot 88 abuts against the projecting member or pin 89 to which it is connected, which then pushes it laterally along in its channel. As the medial bracket is pushed laterally, the medial end of the lower leg, which is pivotally connected to the medial wheel bracket, also moves laterally. As the lower end of the lower leg remains fixed by virtue of its stationary foot bracket, the upper end of the leg is forced to pivot and rise upwards, thereby raising the height of the lower platform. Extension of each lower leg is also controlled by its respective pivotally attached strut.

Thus, initial pivoting of the leg into extension is facilitated by the ramping mechanism of the wedge block. Once an initial degree of extension is achieved with the ramping mechanism, torque is applied with the sliding mechanism. Thus, the initial amount of force required by the user when turning the handle is substantially reduced by virtue of the ramping mechanism, thereby making manual operation viable.

Once the desired height for the lower platform has been reached, the user simply ceases winding the handle, and folds it away into a lower recess defined in the front side of the lower platform. Stowing of the handle also serves to lock the height of the platform, although effective locking of the platform height may occur at any position in the continuous height range once manual turning of the handle ceases. In order to lower the lower platform, the user winds the lower handle in an anti-clockwise direction and the reverse process to the above takes place.

Referring now to FIGS. 18 to 23, the upper support structure 13 comprises left and right upper support portions, 60 and 61 respectively, configured as a mirror image of each other in a midline transverse plane. Each portion comprises an upper front leg 62 and upper rear leg 63.

Each upper leg, 62 and 63, comprises parallel upper front and rear rods, 64 and 65 respectively, interconnected with spacers 28, and ending distally by pivotal connection to an upper foot bracket 66 which is mounted on to the rear portion of the lower platform's upper surface (see also FIGS. 4 and 7). An upper front strut 67 pivotally connects the upper front leg 62 to the upper platform 14, and an upper rear strut 68 pivotally connects the upper rear leg 63 to the upper platform 14.

Figure 24:
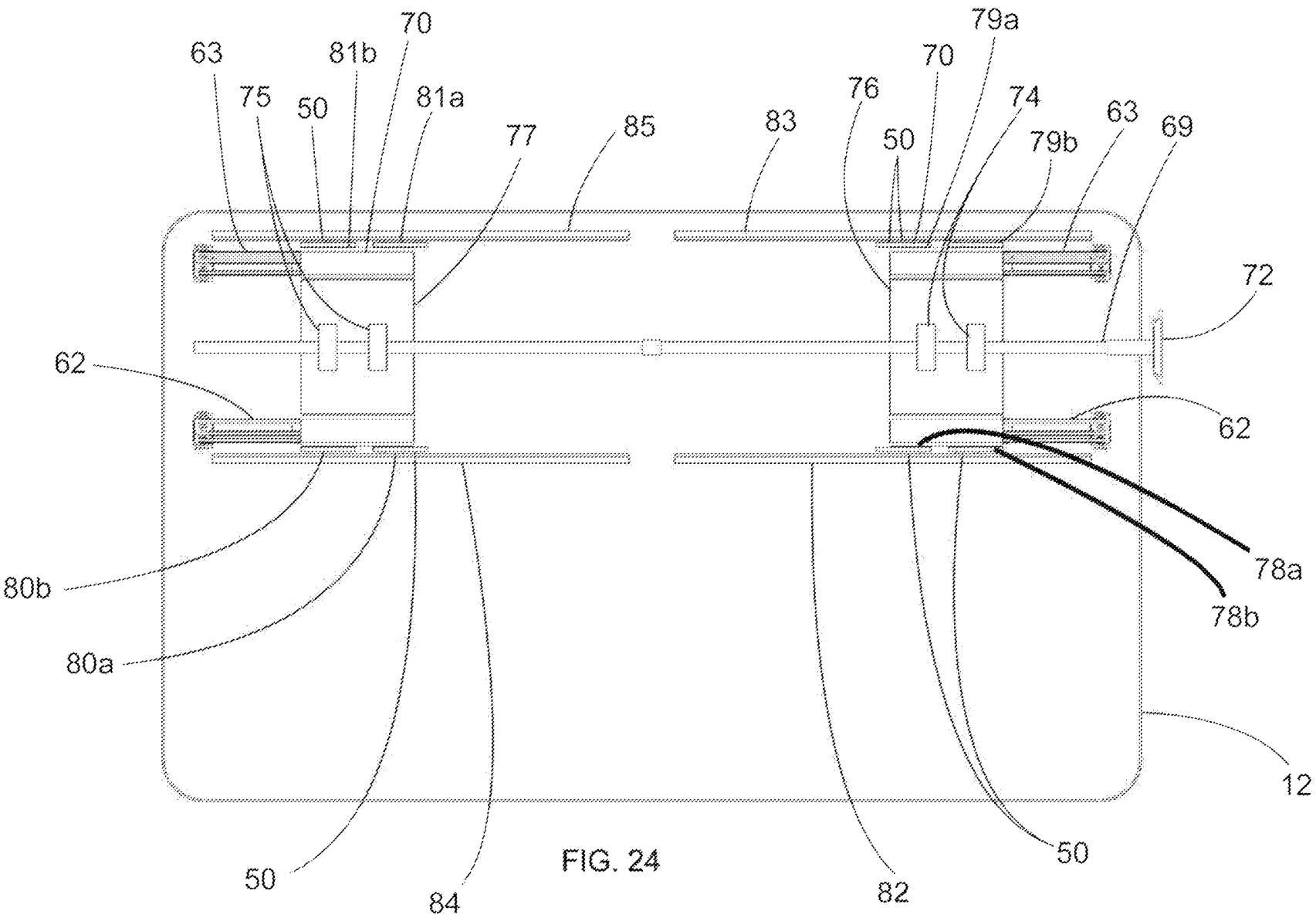
FIG. 24 is a top plan view of the upper adjustment mechanism and upper support structure, mounted atop the lower platform, and in the semi-open configuration.
Figure 25:
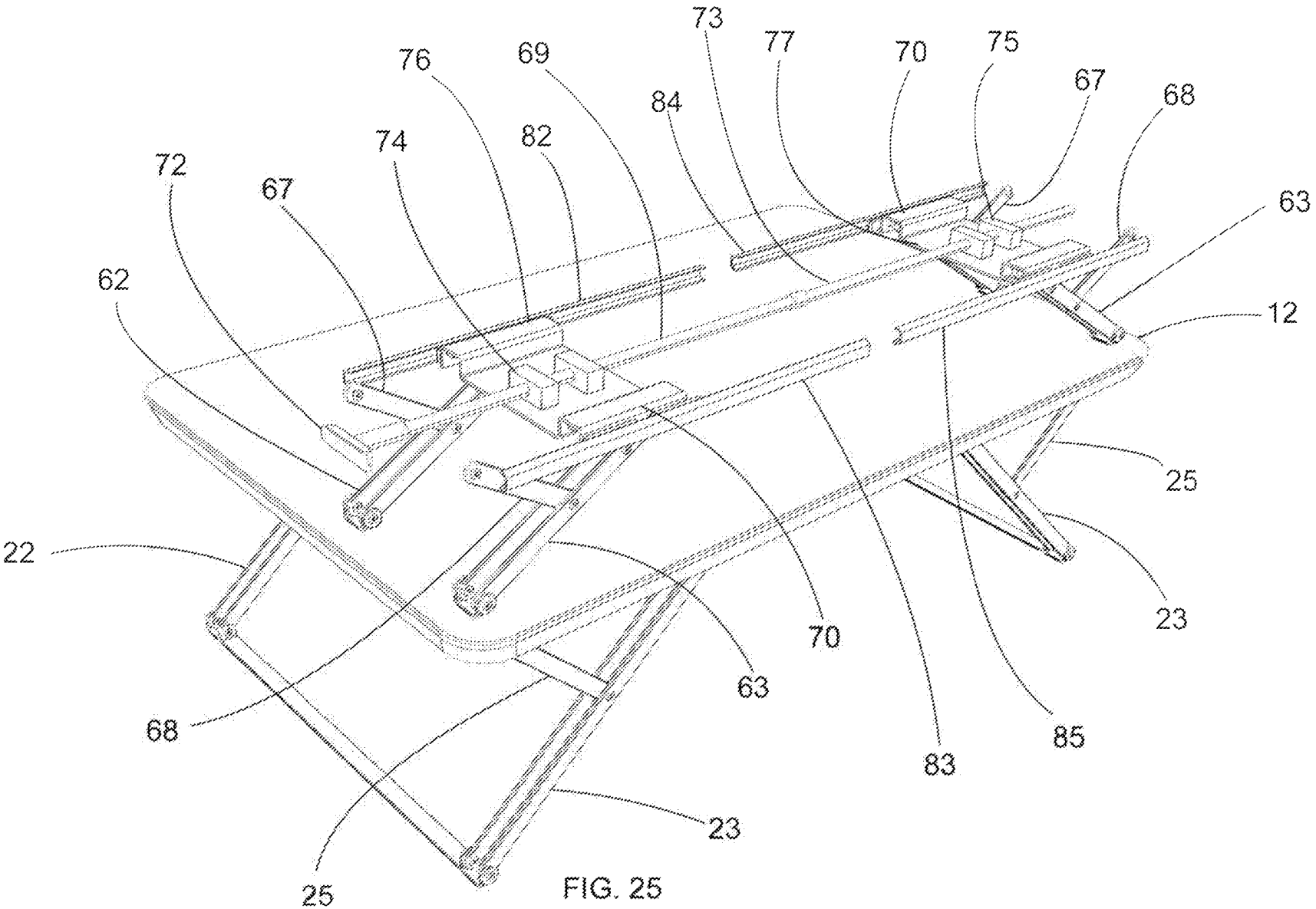
FIG. 25 is a top perspective view of the desk mountable workstation in the semi-open configuration with the upper platform removed.

Referring now to FIGS. 24 and 25, the upper adjustment mechanism comprises an upper rotating portion 69, upper running portion 70, and upper initial assist mechanism 55 (see FIG. 12). The upper rotating portion 69 comprises a retractable upper handle 72 connected with an elongate upper screw member 73 which extends lengthwise beneath the upper platform.

The running portion 70 of the upper adjustment mechanism comprises a pair of first upper running blocks 74 receiving the upper screw member 73 therethrough towards its right end, and a pair of second upper running blocks 75 also receiving the upper screw member 39 therethrough, but towards its left end. The pair of first upper running blocks 74 is fixedly mounted on and moves horizontally with a first upper transverse plate 76. Similarly, the pair of second upper running blocks 75 is fixedly mounted on and moves horizontally with a second upper transverse plate 77. A linear elongated slot 88 with rounded ends (see FIG. 26) is defined in the outer wall of an inverted U-shaped end of the first upper transverse plate 76. In fact, there are four slots 88, one in each of the vertical front and rear walls of each of the first and second upper transverse plates, 76 and 77 respectively.

Attached to the front inverted U-shaped end of the first upper transverse plate 76 is a lateral or outer front first upper wheel bracket 78*b*, and attached to the rear inverted U-shaped end of the first upper transverse plate 76 is a lateral upper first wheel bracket 79*b*. Medial to each of the outer upper first wheel brackets, 78*b* and 79*b*, are inner or medial upper first wheel brackets, 78*a* and 79*a*. Similarly, attached to the front inverted U-shaped end of the second upper transverse plate 77 is a lateral front upper second wheel bracket 80*b*, and attached to the rear inverted U-shaped end of the second upper transverse plate 77 is a lateral rear upper second wheel bracket 81*b*. A pin 89 passing through the most medial, inner or upper spacer of each upper leg, and projecting outwardly through its respective slot, pivotally or rotatably connects each upper leg to its respective inner wheel bracket. Each of the front and rear, upper first and second wheel brackets has a series of three wheels 50 rotatably mounted thereon (see also FIG. 12). The wheels 50 of the pair of front first upper wheel brackets 78 roll or run in a C-shaped front upper first channel 82 which is secured to the anterior underside of the upper platform, whilst the wheels 50 of the pair of rear upper first wheel brackets 79 roll or run in a C-shaped rear upper first channel 83 which is secured to the posterior underside of the upper platform. Similarly, the wheels 50 of the pair of front upper second wheel brackets 80 roll or run in a C-shaped front upper second channel 84 which is secured to the anterior underside of the upper platform, whilst the wheels 50 of the pair of rear upper second wheel brackets 81 roll or run in a C-shaped rear upper second channel 85 which is secured to the posterior underside of the lower platform.

Referring again to FIG. 12, there is shown the upper initial assist mechanism 71, which is substantially the same as the lower initial assist mechanism 55, aside from the reduced scale of it and its interacting components. Therefore, the upper initial assist mechanism 71 and lower initial assist mechanism 55 are both illustrated by the same figures, with at least some shared features being identified using the same reference numerals.

Thus, the upper initial assist mechanism comprises a swing member consisting of a partially wedge shaped block 56 which is fixed to and projects down from the underside of the roof of the inverted U-shaped end of its corresponding upper transverse plate 76. The wedge block 56 of the upper initial assist mechanism has a ramped undersurface 57, angled at about forty five degrees, and which continues into a flat undersurface 58. In fact, the upper initial assist mechanism comprises four upper wedge blocks 56, one for engagement with the second most medial spacer of each upper leg during the initial phase of opening.

In order to manually raise the height of the upper platform 12 independently of the lower platform 12, a user first retracts the upper handle 72. The user then grasps the handle 72 and rotates it in a clockwise direction. The clockwise rotation of the handle 72 in turn causes clockwise rotation of the upper screw member 73, resulting in the first and second pairs of upper running blocks, 74 and 75 respectively, moving laterally out along the upper screw member towards opposite sides of the upper platform. Being affixed to the first and second pairs of upper running blocks, the first and second upper transverse plates, 76 and 77 respectively, are moved laterally towards their respective sides of the upper platform 14. Concomitantly, the wheels 50 of the front and rear, first and second medial wheel brackets, 78*a*, 79*a*, 80*a*, 81*a*, roll laterally outwards along and within the front and rear, first and second, channels, 82-85.

As shown in FIGS. 13 to 17 and 26 to 31, lateral movement of the transverse plates also results in concomitant lateral movement of respective wedge blocks 56. As each wedge blocks move laterally, its ramped undersurface 57 runs over the second most medial spacer 28 of the corresponding upper leg, thereby causing the second spacer to effectively run down the ramp during the first fifteen degrees or so of leg extension. As this occurs, the leg is forced to swing out, rotating about the leg's pivotal connection to its respective medial wheel bracket. Initially, whilst the ramp swings the upper leg out, the medial wheel bracket remains stationary until the medial end of the slot 88 abuts against the projecting member or pin 89 to which it is attached, which then pushes it laterally along in its channel. As the medial bracket is pushed laterally, the medial end of the lower leg, which is pivotally connected to the medial wheel bracket, also moves laterally. As the lower end of the upper leg remains fixed by virtue of its stationary foot bracket, the upper end of the leg is forced to pivot and rise upwards, thereby raising the height of the upper platform. Extension of each upper leg is also controlled by its respective pivotally attached strut.

Thus, initial pivoting of the upper leg into extension is facilitated by the ramping mechanism of the wedge block. Once an initial degree of extension is achieved with the ramping mechanism, torque is applied with the sliding mechanism. Thus, as for the lower platform, the initial amount of force required by the user to raise the upper platform when turning the handle is substantially reduced by virtue of the ramping mechanism, thereby making manual operation viable.

Once the desired height for the upper platform has been reached, the user simply ceases winding the handle, and then retracts it into an upper recess 87 defined in the right side of the upper platform. Stowing of the handle also serves to lock the height of the platform, although effective locking of the platform height may occur at any position in the continuous height range once manual turning of the handle ceases. In order to lower the upper platform, the user winds the upper handle in an anti-clockwise direction and the reverse process to the above takes place.

Figure 32:
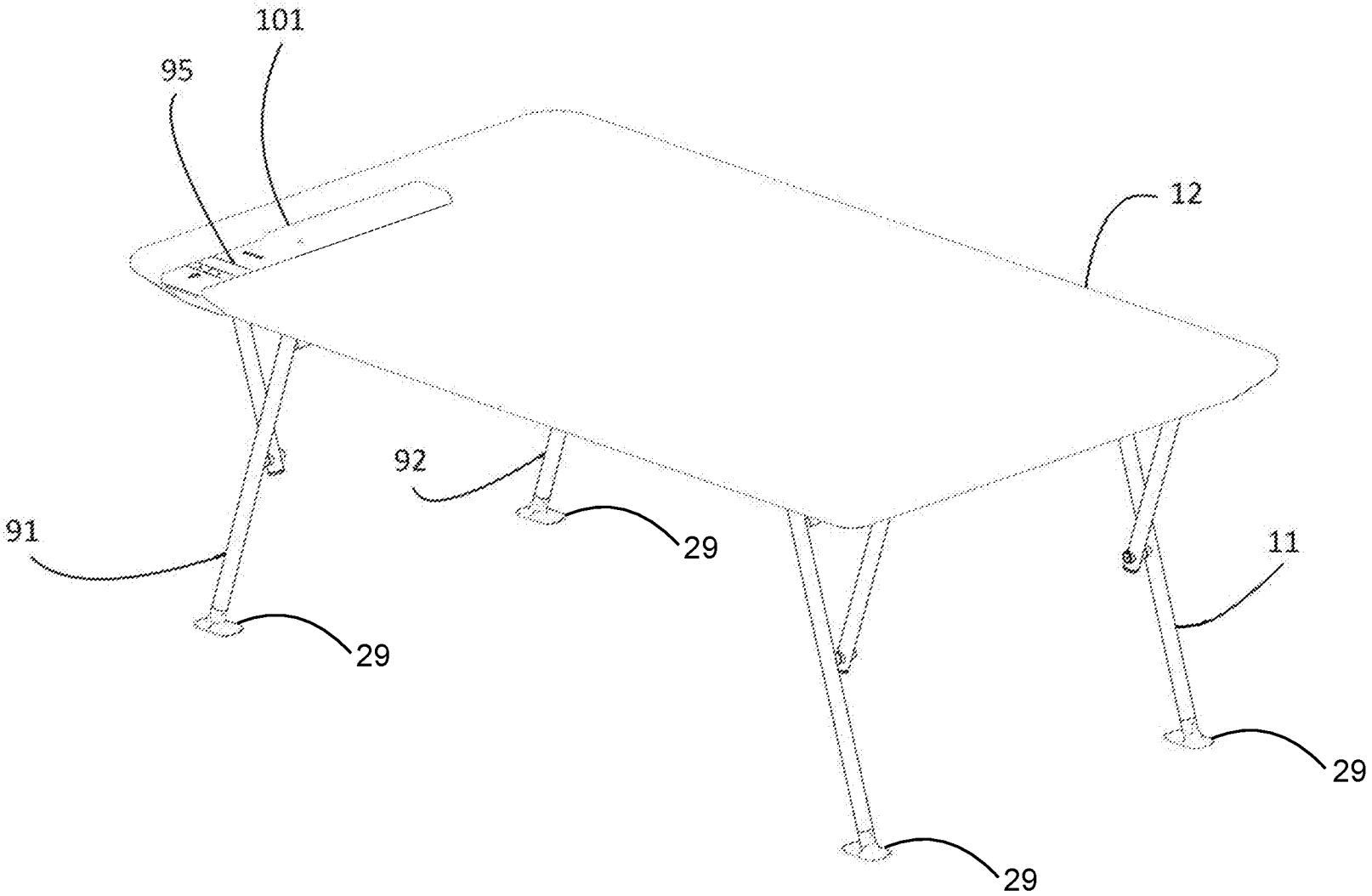
FIG. 32 is a front perspective view from above of a second version of a desk mountable workstation in an open configuration.
Figure 33:
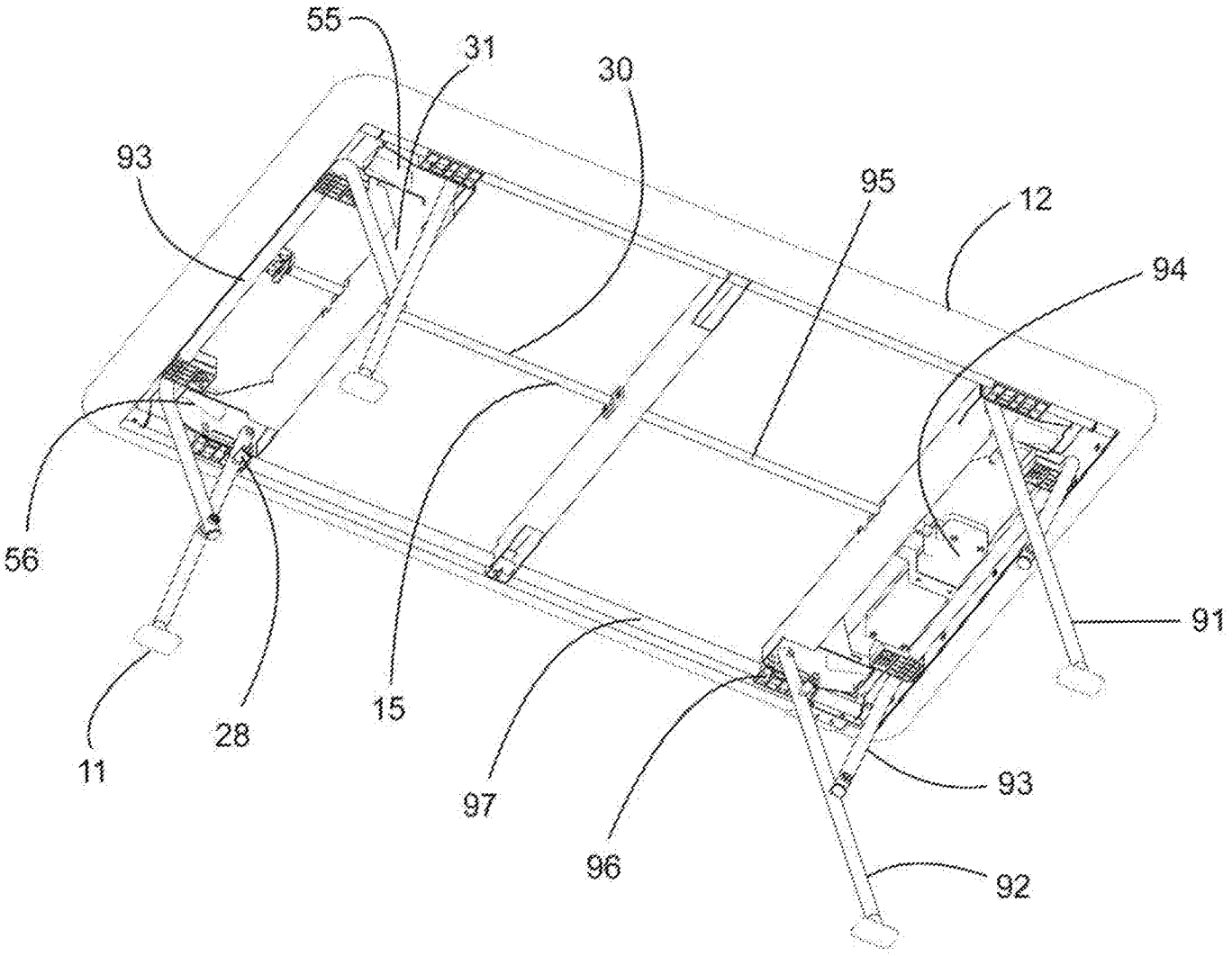
FIG. 33 is a rear perspective view from below of the second version workstation in an open configuration.
Figure 34:
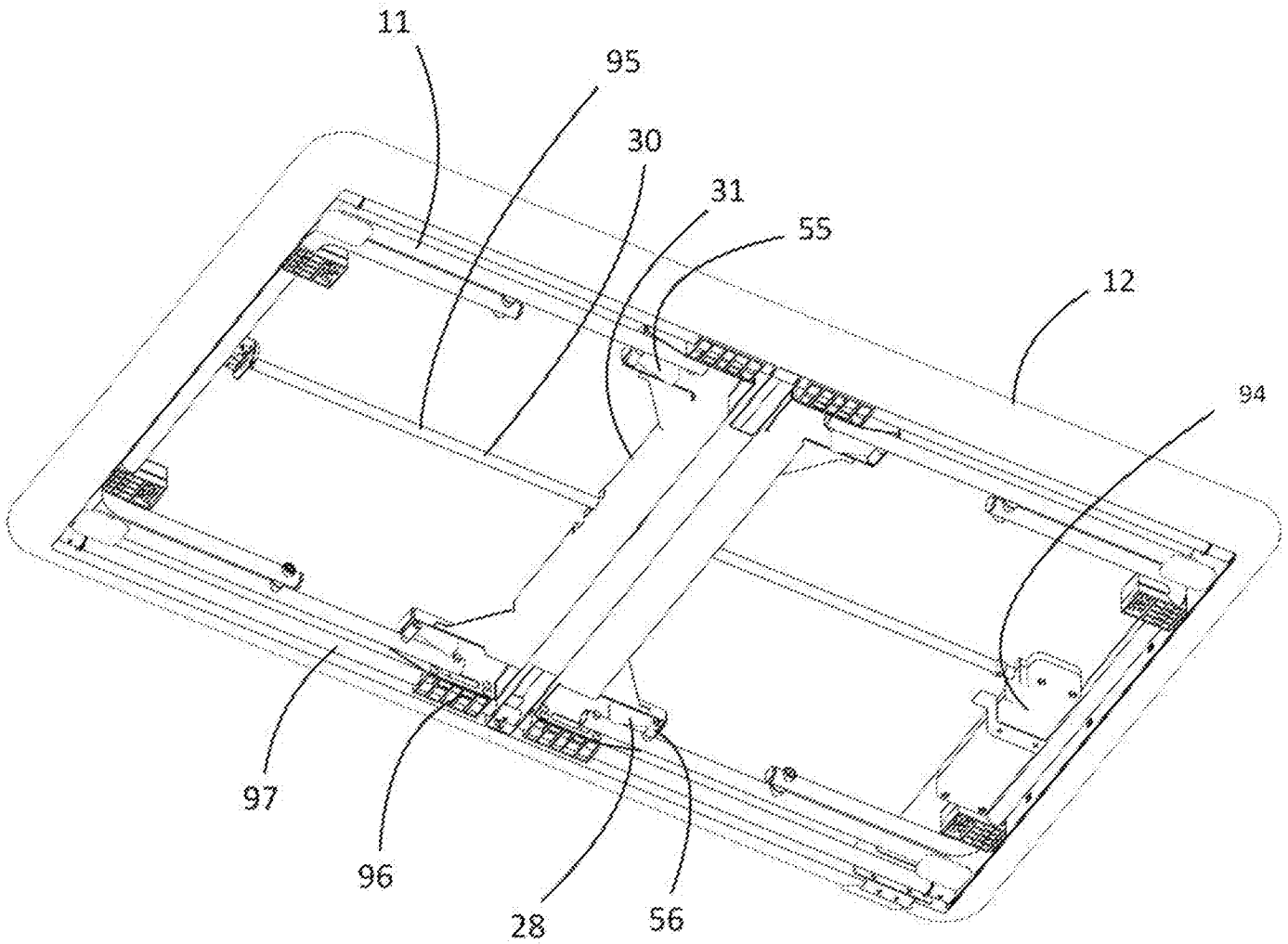
FIG. 34 is a rear perspective view from below of the second version workstation in a closed configuration.

Referring now to FIGS. 32 to 34, there is shown a second version of a desk mountable workstation, generally designated 90. Like the first version 10, the second version 32 is continuously movable or adjustable between a fully closed or flat configuration (as shown in FIG. 34), an intermediate or part open configuration (not shown for this version), and a fully open or extended configuration (as shown in FIGS. 32 and 33). The second version of the desk mountable workstation 90 is similar in many respects to the first version 10. Thus, features of the second version 90 alike or in common with the first version 10 are labelled with the same reference numerals. However, the second version 90 differs from the first version 10, at least in the following aspects.

Like the first version 10, the second version comprises an adjustable (lower) support structure 11 for mounting or seating on a desk top, a (lower) platform 12 mounted on the support structure 11, and an (lower) adjustment mechanism 15 for continuous adjustment of the support structure 11 and thereby the height of the platform 12 with respect to the desk top. However, unlike the first version 10, the second version does not comprise an adjustable upper support structure mounted atop the (lower) platform, an upper platform, nor an upper adjustment mechanism. That is, the monitor platform has been omitted from the second version.

The (lower) support structure 11 differs in the second version from the first version in that its front and rear legs, 91 and 92 respectively, comprise a single cylindrical beam rather than two parallel front and rear rods interconnected with spacers. Further, toward each side of the second version 90, the front and rear legs, 91 and 92 respectively, are pivotally connected to the platform 12 by a single C-shaped strut member 93, rather than the separate front and rear struts described for the first version 10. Whilst each of the legs 91, 92 is rotatably or pivotally connected at its lower or outer end to a stationary foot member or bracket 29, the transverse base rod 21 present in the first version is omitted from the second version.

As per the first version 10, the adjustment mechanism 15 of the second version 90 comprises a rotating portion 30, a running portion 31, and an initial assist mechanism 55 (see FIGS. 33 and 34). However, unlike the manual adjustment mechanism 15 of the first version, the second version comprises an automatic adjustment mechanism 15. Thus, rather than comprising a foldable handle, the rotating portion 30 of the second version comprises automatic torque producing means in the form of an electric motor 94 which is rotatably connected at an end of a single lengthwise screw member 95. Further, the second version comprises a computer 101 having a user interface 95 (see FIGS. 32 and 35) which will be described in more detail below.

The running portion 30 of the second version 90 differs from the first version in that, rather than comprising wheel brackets which roll in C-shaped channels, it comprises sleeve brackets or members 96 which at least partially enclose and run or slide along respective cylindrical guide rails 97 (see FIGS. 33 and 34).

Figure 35:
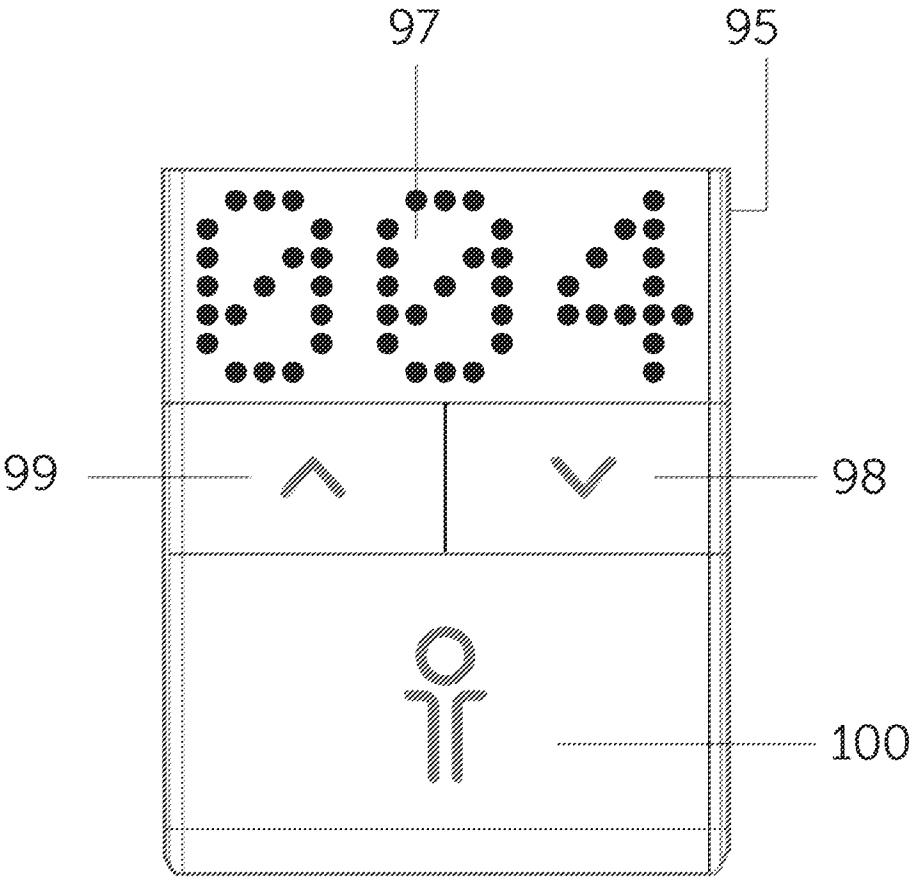
FIG. 35 is a diagram of a user interface for facilitating electronic height adjustment of the second version workstation.

Referring now to FIG. 35, an external view of the user interface 95 of the computer 101 is shown. It comprises a three digit dot matrix display 97, user input means in the form of a down button 98 and an up button 99, each being used for platform height adjustment and display input, and a 'stand' button 100 used to toggle between sitting and standing saved height pre-sets, or used as an 'enter' or 'select' button within menus.

Figure 36:
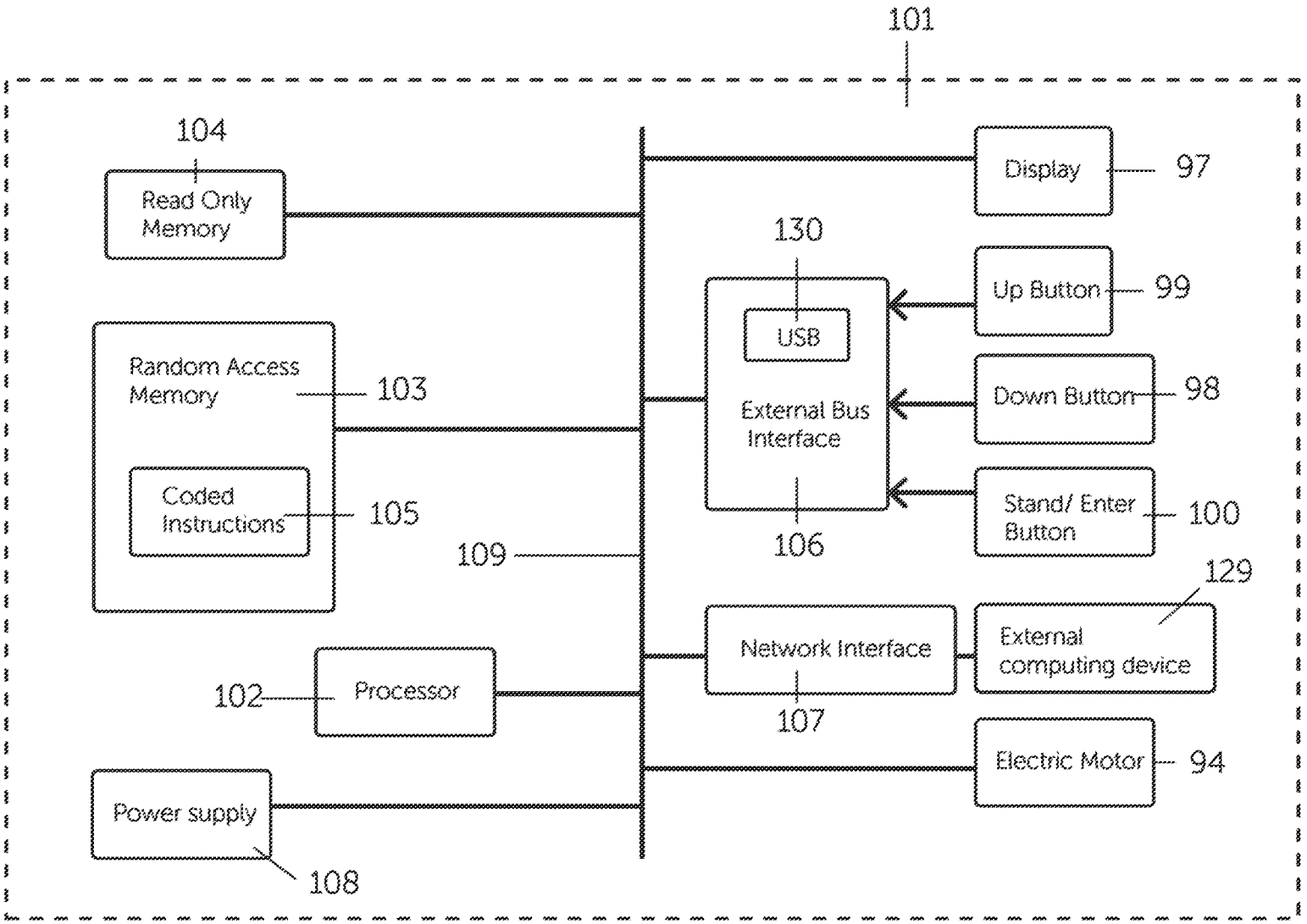
FIG. 36 is a block diagram of computer hardware for implementing platform height adjustment of the second version workstation.

FIG. 36 is a schematic diagram of non-limiting example hardware componentry of and/or in connection with the computer 101. The example implementation shown includes a general purpose programmable processor 102, such as the Intel® family of microprocessors. The processor 102 is adapted to execute coded instructions 105 present in a main memory such as random access memory (RAM) 103, for example dynamic random access memory (DRAM), and/or read only memory (ROM) 104, for example flash memory. To receive input signals from the down, up and stand buttons, 98, 99 and 100 respective, the example includes an external bus interface 106. The external bus interface 106 may comprise one or more USB ports for connection of peripherals. The example implementation also includes a network interface 107, e.g. a wireless LAN interface, to enable the processor 102 to interact with a remote server 129. An internal power supply 108, such as a battery, may be provided, or as in this case, the power supply 108 may be external, such as may be provided from a mains power outlet. Hardware components, such as the processor and memories, are communicably linked via a bus 109. The processor 102 may execute, among other things, machine accessible instructions 105 causing operation of the electric motor in response to user input via the input buttons, 98, 99 & 100.

In a suitable form, the network interface 107 allows the workstation 90 to communicate with and/or be controlled by the remote server 129 or an external computing device 129 such as a smart phone, smart watch, desktop computer, laptop computer, or remote control. Thus, components of the hardware such as the memory 103 & 104, processor 102, display 97 and user input means 98, 99 & 100 such as buttons, a mouse, or keyboard, may be physically located in or connected with one or more external computing devices 129 instead of or as well as in or with the workstation computer 101. The memory of the external computing device may comprise an application or program with coded instructions 105 for execution by the external computing device's processor, which processor may direct the workstation computer 101 to perform various functions such as raising or lowering the height of the platform. Thus, a user may control the height of the platform or various menu functions using their mobile phone or a laptop computer, for instance.

Figure 37:
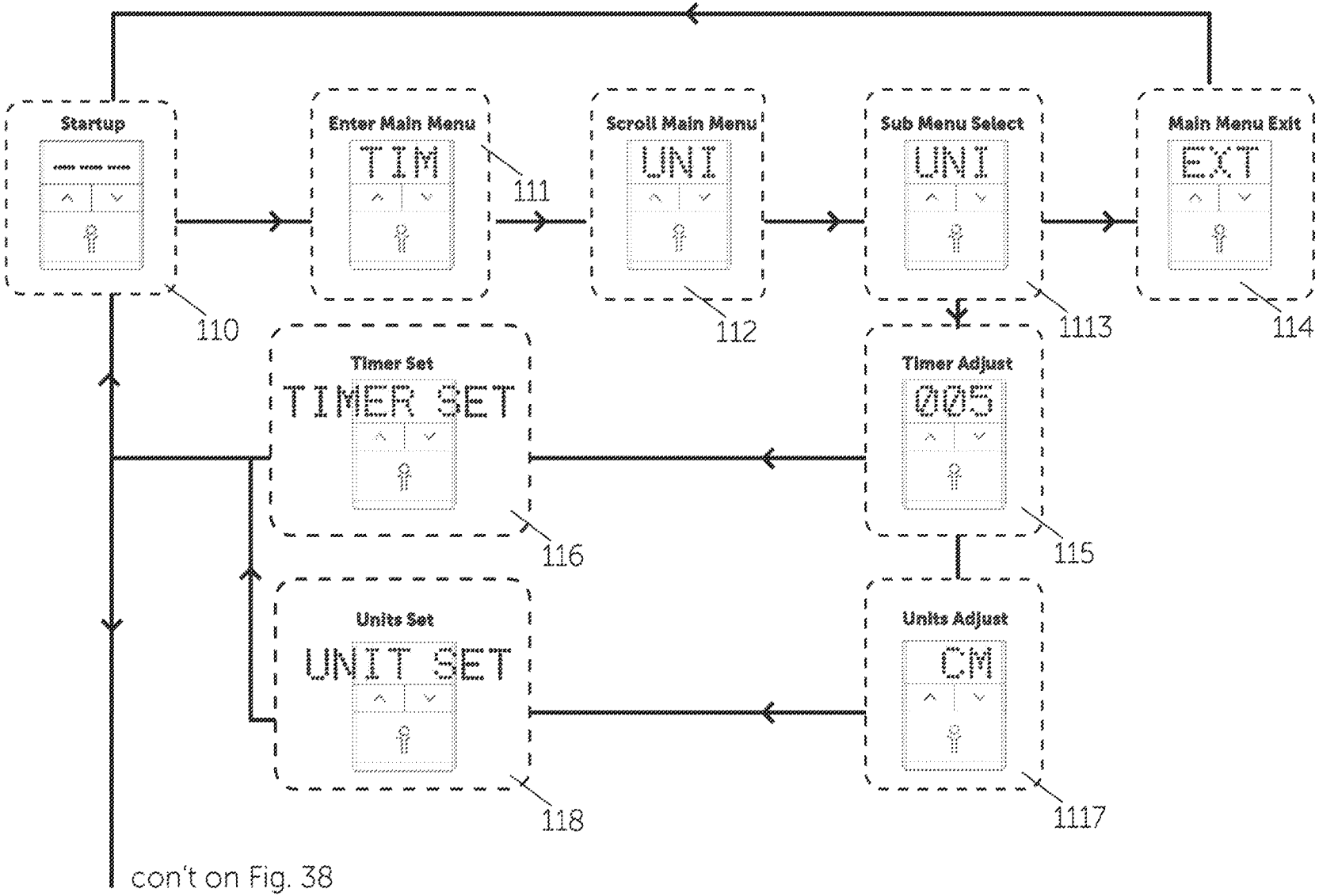
FIGS. 37 & 38 combined provide a flowchart illustrating an example process that may be implemented by the computer.
Figure 38:
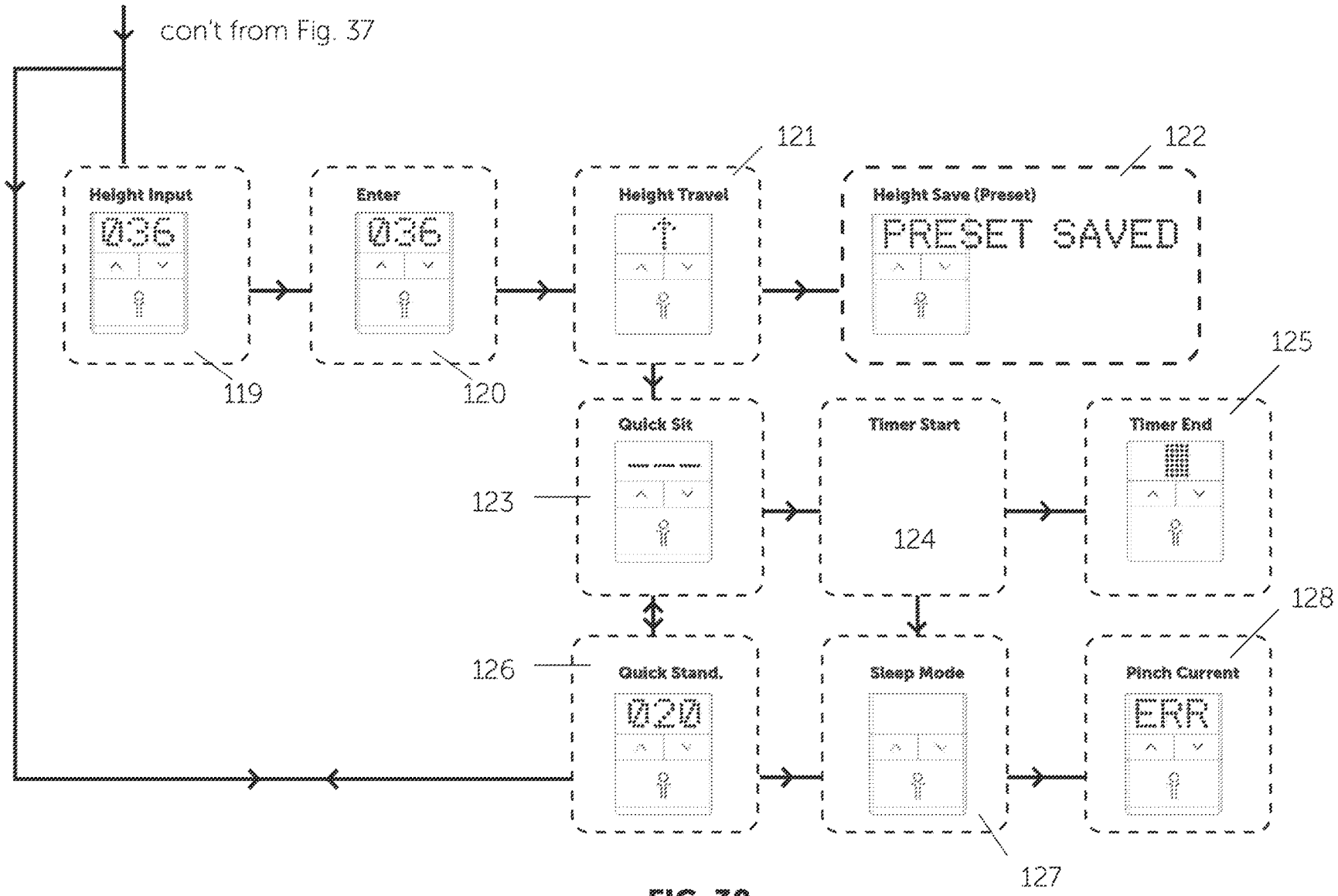

FIGS. 37 & 38 together illustrate a flowchart representative of an example process that may be executed by the processor 102. In the example provided, the flowchart may be embodied in coded instructions 105 stored in RAM 103, although it is also envisaged that in other forms the instructions may, for example, be stored in a tangible medium such as flash memory. In other forms, various combinations of firmware, software and/or hardware may be used to implement the flow chart, as would be understood by a person skilled in the art. Further, it is envisaged that in other forms the order of execution of the blocks may be changed, and the blocks described in FIG. 37 may be changed, divided, eliminated, combined, etc. Each of the blocks in FIG. 37 represents or comprises a step, module, function and/or application involved in the example process.

In the example shown, the process of FIG. 37 begins at block 110 which represents a start-up step, module, function and/or application. This step involves plugging the computer 101 into the power source 108 so that the processor 102 automatically displays the default height of the platform 12 above the desk on the display 97, that being zero centimeters (displayed as ' - - -') in this instance. This represents the home screen.

At block 111, a user may enter the main menu by depressing both down and up buttons, 98 and 99 respectively, for two seconds. This results in a first sub menu item "TIM" (timer) being displayed. At block 112, the user may scroll through the main menu by pressing up and/or down buttons to vertically scroll through the submenu items "TIM" (timer), "UNI" (units) and "EXT" (exit) displayed separately on the display screen 97. At block 113, the user may select a displayed sub menu items by a single press of the stand/enter button 100. At block 114, the user may exit the main menu by scrolling to the submenu item "EXT" (exit) on the display and pressing the stand/enter button once.

At block 115, where the user has entered the "TIM" (timer) submenu in step 113, the user may adjust the length of time, in minutes, for which the platform is to remain stationary before the timer runs out and triggers a display, as discussed further below. In this embodiment, the timer operates whilst the platform is stationary at any height, although it is envisaged that in other embodiments the timer may be operable only at its lowest position zero centimetres above the platform, that being at the working sitting height for the user. Up and down buttons are used to adjust to the desired timer duration, with the display blinking time in minutes. In the particular embodiment shown, the timer is set to "000" (off) by default, and the maximum time which may be set is one hundred minutes. At block 116, the user sets/saves the desired time by depressing the stand/enter button for 1.5 seconds. With the timer set, the words "TIMER SET" horizontally scroll across before exiting the timer configuration to the home screen.

At block 117, where the user has entered the "UNI" (units) submenu in step 113, the user may adjust the units used for quantifying the height of the platform above the desk by pressing the up or down button to scroll through options "CM" (centimetres) and "IN" (inches) which blink on the display. At block 118, the user sets/saves the desired units by depressing the stand/enter button for one and a half seconds. With the units set, the words "UNIT SET" scroll horizontally across the display screen before the unit configuration is exited to the home screen.

At block 119, on the home screen, the user adjusts the desired platform height by pressing the up or down buttons to increase or decrease the quantity displayed. The display blinks as the height numbers are scrolled through and the user can hold the buttons down for faster scrolling. In this embodiment, the display jumps from zero to twenty (as a platform height of less than twenty centimetres is not allowed) and then displays one centimetre increments (or 0.5 inch increments) from twenty to forty four centimetres. At block 120, the user may set the desired height by depressing the stand/enter button for one and a half seconds, at which time the display stops blinking. At block 121, after a one second delay, the platform rises to the set height above the desk. The display flashes an upwardly directed arrow for the first twenty centimetres of travel. Between and including heights of twenty and forty four centimetres, corresponding height numbers scroll vertically up on the display during travel. Once the set height is reached, the corresponding height number remains displayed. When the platform is in motion, pressing of any button cancels travel. At block 122, once the desired height has been reached, it can be saved in the memory by holding the stand/enter button for one and a half seconds. The words 'PRESET SAVED' then horizontally scroll across the display to confirm pre-set height save.

In another version, the user can enter their own height, or length of some other feature of their body such as leg length, and stored in memory is a database containing suitable platform heights which correspond to the user's height or body part length. Using this information, the workstation is able to adjust to a platform height appropriate to the user's height or body part length.

At block 123, when the desk is raised (to any available position), the user may quickly lower the platform back to its lowest position for sitting at their desk by pressing the stand/enter button. The display flashes a down arrow for one second, before travel begins and the platform lowers to its base position with corresponding height numbers scrolling vertically down on the display during travel, and a downward arrow is displayed again for the last twenty centimetres of lowering. Once the lowest position is reached, the displays shows a platform height of zero centimetres as ' - - -'. At block 124, once the desk becomes stationary at the base position, the timer starts automatically. Any movement of the desk resets the timer. At block 125, elapse of the timer triggers pulsing of a full middle segment display. Pressing any button stops the middle segment display and resets the timer loop.

At block 126, when the desk is lowered to its lowest position, the platform may be quickly raised to the pre-set height suitable for working at whilst the user is standing (or supported on some form of high stool), or if there is no pre-set height, to a default standing height (twenty centimetres in this instance), by a single press of the stand/enter button. Once pressed, the display blinks the saved pre-set height or default height for 1.5 seconds, and then the platform begins to travel as per block 121.

At block 127, if there is no processor activity for sixty seconds, the processor switches off the display and enters sleep mode. Pressing of any button will awaken the display.

At block 128, if height adjustment is obstructed or there is a weight overload, pinch current overload protection is triggered, with 'ERR' (error) displayed and piezo buzz warning activated.

While this invention has been described in connection with specific embodiments thereof, it will be understood that it is capable of further modification(s). The present invention is intended to cover any variations, uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the broad consistory statements. Various modifications and equivalent arrangements are intended to be included within the spirit and scope of the invention and consistory statements herein. Therefore, the specific embodiments are to be understood to be illustrative of the many ways in which the principles of the present invention may be practiced.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprise", "comprises," "comprising," "including," and "having," or variations thereof are inclusive and therefore specify the presence of stated features, integers, steps, operations, elements, and/or components, but do not preclude the presence or addition of one or more other features, integers, steps, operations, elements, components, and/or groups thereof.

The method steps, processes, and operations described herein are not to be construed as necessarily requiring their performance in the particular order discussed or illustrated, unless specifically identified as an order of performance. It is also to be understood that additional or alternative steps may be employed. Reference to positional descriptions, such as lower and upper, are to be taken in context of the embodiments depicted in the figures, and are not to be taken as limiting the invention to the literal interpretation of the term but rather as would be understood by the skilled addressee.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The invention claimed is:

1. An adjustable desk mountable workstation comprising:

a platform adapted to support a computer keyboard thereon; and a support structure for standing or mounting on a desk and on which the platform is disposed, the support structure being adjustable so as to alter the height of the platform above the desk;

the support structure comprises at least one leg having first and second ends, wherein adjustment of the support structure involves concomitant pivoting of the at least one leg at its first end, and pivoting and displacement of the at least one leg at its second end;

the support structure is adjustable to alter the height of the platform above the desk between a lowered position in which the at least one leg is folded towards or along the platform and a raised position in which the at least one leg is opened away from the platform;

wherein the workstation further comprises at least one swing member adapted to cause rotation of the at least one leg about its second end during initial raising of the platform from the lowered position;

the platform has a frame, the support structure has at least one running member adapted to run along the frame, the second end of the at least one leg is pivotally connected with the at least one running member, and the at least one swing member is adapted to cause rotation of the at least one leg about its connection with the at least one running member; and wherein elevation of the platform from the lowered position is initiated by the at least one swing member urging the at least one leg to rotate downwardly about its rotatable connection with the at least one running member, following which movement of the at least one running member along the frame causes displacement and further downward rotation of the second end of the at least one leg, resulting in opening of the at least one leg and thereby raising of the platform.

2. The adjustable desk mountable workstation according to claim 1, wherein during adjustment of the support structure, there is no displacement of the at least one leg at its first end, and the displacement of the at least one leg at its second end occurs in a substantially horizontal direction.

3. The adjustable desk mountable workstation according to claim 1, wherein adjustment of the support structure alters the height of the platform without any substantial horizontal displacement of the platform.

4. The adjustable desk mountable workstation according to claim 1, wherein the support structure comprises at least one stationary base or foot for standing or mounting on the desk, the first end of the at least one leg being rotatably connected to the at least one base or foot.

5. The adjustable desk mountable workstation according to claim 1, wherein the support structure comprises at least one strut having first and second ends, the first end of the at least one strut being pivotally connected to the at least one leg and the second end of the at least one strut being rotatably connected with the platform.

6. The adjustable desk mountable workstation according to claim 1, wherein the at least one swing member comprises a ramped portion along which a portion of the at least one leg travels during initial elevation of the platform from the lowered position.

7. The adjustable desk mountable workstation according to claim 6, wherein the workstation comprises pairs of opposed swing members, running members, and legs.

8. The adjustable desk mountable workstation according to claim 7, wherein the workstation comprises a screw mechanism for continuous adjustment of the support structure.

9. The adjustable desk mountable workstation according to claim 1, wherein the support structure is continuously adjustable.

10. The adjustable desk mountable workstation according to claim 1, comprising an automatic adjustment mechanism for automatically adjusting the height of the platform above the desk.

11. The adjustable desk mountable workstation according to claim 10, wherein the height of the platform is automatically adjustable to a predetermined height.

12. The adjustable desk mountable workstation according to claim 11 comprising a timer adapted to run whilst the platform height remains stationary, and signal to a user when a predetermined time period expires.

13. The adjustable desk mountable workstation according to claim 12, wherein the timer is adapted to automatically reset on height adjustment of the platform.

14. The adjustable desk mountable workstation according to claim 10 comprising a motor, wherein in operation, the motor creates a rotational torque for adjusting the support structure, thereby raising or lowering the platform.

15. The adjustable desk mountable workstation according to claim 10 comprising user input means in the form of one or more touch or push buttons.

16. The adjustable desk mountable workstation according to claim 10 comprising a display for displaying numerals representing the height of the platform with respect to the desk or floor.

17. The adjustable desk mountable workstation according to claim 1, comprising:

an upper platform adapted to support a monitor thereon; and an upper support structure for standing or mounting on the platform and on which the upper platform is disposed, the upper support structure being adjustable so as to alter the height of the upper platform above the platform.

18. The adjustable desk mountable workstation according to claim 17, wherein the upper support structure comprises at least one upper leg having first and second ends, wherein adjustment of the upper support structure involves concomitant pivoting of the at least one upper leg at its first end, and pivoting and displacement of the at least one upper leg at its second end.

19. The adjustable desk mountable workstation according to claim 18, wherein during adjustment of the upper support structure, there is no displacement of the at least one upper leg at its first end, and the displacement of the at least one upper leg at its second end occurs in a substantially horizontal direction.

20. The adjustable desk mountable workstation according to claim 17, wherein adjustment of the upper support structure alters the height of the upper platform without horizontal displacement of the upper platform.

21. The adjustable desk mountable workstation according to claim 17, wherein the upper support structure comprises at least one upper stationary base or foot for standing or mounting on the platform, the first end of the at least one upper leg being rotatably connected to the at least one upper base or foot.

22. The adjustable desk mountable workstation according to claim 17, wherein the upper support structure comprises at least one upper strut having first and second ends, the first end of the at least one upper strut being pivotally connected to the at least one upper leg and the second end of the at least one upper strut being rotatably connected with the upper platform.

23. The adjustable desk mountable workstation according to claim 17, wherein the upper support structure is adjustable to alter the height of the upper platform above the platform between a lowered position in which the at least one upper leg is folded towards or along the upper platform and a raised position in which the at least one upper leg is opened away from the upper platform.

24. The adjustable desk mountable workstation according to claim 23 comprising at least one upper swing member adapted to cause rotation of the at least one upper leg about its second end during initial raising of the upper platform from its lowered position.

25. The adjustable desk mountable workstation according to claim 24, wherein the upper platform has an upper frame, the upper support structure has at least one upper running member adapted to run along the upper frame, the second end of the at least one upper leg is pivotally connected with the at least one upper running member, and the at least one upper swing member is adapted to cause rotation of the at least one leg about its connection with the at least one upper running member, wherein elevation of the at least one upper platform from its lowered position is initiated by the at least one upper swing member urging the at least one upper leg to rotate downwardly about its rotatable connection with the at least one upper running member, following which outward movement of the at least one upper running member along the upper frame causes displacement and further downward rotation of the second end of the at least one upper leg, resulting in opening of the at least one upper leg and thereby raising of the upper platform.

26. The adjustable desk mountable workstation according to claim 25, wherein the at least one upper swing member comprises at least one upper ramped portion along which a portion of the at least one upper leg travels during initial elevation of the upper platform from its lowered position.

27. The adjustable desk mountable workstation according to claim 26, wherein the workstation comprises pairs of opposed upper swing members, upper running members, and upper legs.

28. The adjustable desk mountable workstation according to claim 17, wherein the upper support structure is continuously adjustable.

29. The adjustable desk mountable workstation according to claim 28, wherein the workstation comprises an upper screw mechanism for continuous adjustment of the upper support structure.

30. An adjustable desk mountable workstation comprising:

a platform adapted to support a computer keyboard thereon; and a support structure for standing or mounting on a desk and on which the platform is disposed, the support structure being adjustable so as to alter the height of the platform above the desk;

the support structure comprises at least one pair of legs extending in opposed directions, each leg having first and second ends, wherein adjustment of the support structure involves concomitant pivoting of the at least one leg at its first end, and pivoting and displacement of the at least one leg at its second end;

the support structure is adjustable to alter the height of the platform above the desk between a lowered position in which the legs of the at least one pair of opposed legs are folded towards or along the platform and a raised position in which the legs of the at least one opposed pair of legs are opened away from the platform;

the workstation further comprises at least one swing member adapted to cause rotation of each leg of the at least one opposed pair of legs about its second end during initial raising of the platform from the lowered position;

the platform has a frame, the support structure has at least one running member adapted to run along the frame, the second end of each leg of the at least one opposed pair of legs is pivotally connected with the at least one running member, and the at least one swing member is adapted to cause rotation of each leg of the opposed pair of legs about its connection with the at least one running member;

elevation of the platform from the lowered position is initiated by the at least one swing member urging each leg of the at least one opposed pair of legs to rotate downwardly about its rotatable connection with the at least one running member, following which movement of the at least one running member along the frame causes displacement and further downward rotation of the second end of each leg, resulting in opening of each leg and thereby raising of the platform; and the at least one swing member comprises a respective ramped portion along which a portion of each leg travels during initial elevation of the platform from the lowered position whereby initial pivoting of the leg is facilitated by a ramping mechanism provided by the respective ramp portion of the swing member.

31. The adjustable desk mountable workstation according to claim 30, wherein the workstation comprises pairs of opposed swing members, running members, and legs.

* * * * *